US012024960B2

(12) United States Patent
Millward et al.

(10) Patent No.: US 12,024,960 B2
(45) Date of Patent: Jul. 2, 2024

(54) SYSTEM FOR PERFORMING COMPARISON OF RECEIVED CUTTINGS WEIGHTS FROM A RIG SITE CUTTINGS STORAGE UNIT AND EXPECTED CUTTINGS WEIGHT CALCULATED USING WELL BORE GEOMETRY AND RECEIVED REAL TIME FORMATION DENSITY DATA FROM LWD TOOLS

(71) Applicant: Halliburton Energy Services, Inc., Houston, TX (US)

(72) Inventors: Benjamin Millward, Stavanger (NO); Paul Brown, Aberdeen (GB); Thomas Berg, Stavanger (NO)

(73) Assignee: Halliburton Energy Services, Inc., Houston, TX (US)

( * ) Notice: Subject to any disclaimer, the term of this patent is extended or adjusted under 35 U.S.C. 154(b) by 338 days.

(21) Appl. No.: 17/665,009

(22) Filed: Feb. 4, 2022

(65) Prior Publication Data

US 2022/0372871 A1 Nov. 24, 2022

Related U.S. Application Data

(60) Provisional application No. 63/191,722, filed on May 21, 2021.

(51) Int. Cl.
*E21B 21/06* (2006.01)
*E21B 37/00* (2006.01)
(Continued)

(52) U.S. Cl.
CPC ..... *E21B 21/066* (2013.01); *E21B 37/00* (2013.01); *E21B 44/00* (2013.01); *E21B 47/04* (2013.01); *E21B 2200/20* (2020.05)

(58) Field of Classification Search
CPC ..... E21B 21/08; E21B 21/066; E21B 37/00; E21B 45/00; E21B 49/003; E21B 44/00; E21B 47/04; E21B 2200/20
(Continued)

(56) References Cited

U.S. PATENT DOCUMENTS 4,412,130 A 10/1983 Winters
4,413,511 A 11/1983 Godbey
(Continued)

FOREIGN PATENT DOCUMENTS

EP 2802738 B1 10/2018

OTHER PUBLICATIONS

Acknowledgment receipt and specification for International application entitled "System for Performing Comparison of Received Cuttings Weights From a Rig Site Cuttings Storage Unit and Expected Cuttings Weight Calculated Using Well Bore Geometry and Received Real Time Formation Density Data From LWD Tools," by Benjamin Millward et al., filed Feb. 9, 2022 as International application No. PCT/US2022/15751.
(Continued)

*Primary Examiner* — John H Le
(74) *Attorney, Agent, or Firm* — Conley Rose, P.C.; Rodney B. Carroll

(57) ABSTRACT

A system for adapting drilling of a borehole in a subterranean formation based on comparing a received cuttings weight to an expected cuttings weight. The system comprises a processor; a non-transitory memory; at least one display; and an application stored in the non-transitory memory that, when executed by the processor, determines the received cuttings weight based on data received from a cuttings storage unit (CSU); determines the expected cuttings weight based on a current borehole depth, on a drill bit geometry, and on a cuttings density value; and presents a
(Continued)

representation of the received cuttings weight and a representation of the expected cuttings weight on the at least one display, whereby at least one parameter of drilling of the borehole is adapted based on comparing the representation of the received cuttings to the representation of the expected cuttings weight.

20 Claims, 12 Drawing Sheets

(51) Int. Cl.
*E21B 44/00* (2006.01)
*E21B 47/04* (2012.01)

(58) Field of Classification Search
USPC ..... 702/173
See application file for complete search history.

(56) References Cited

U.S. PATENT DOCUMENTS

| | | | | |
|---|---|---|---|---|
| 5,205,164 | A | 4/1993 | Steiger et al. | |
| 5,327,984 | A | 7/1994 | Rasi et al. | |
| 6,003,834 | A | 12/1999 | Read | |
| 6,357,536 | B1 | 3/2002 | Schrader et al. | |
| 6,410,862 | B1 | 6/2002 | Lecann | |
| 6,665,636 | B1 | 12/2003 | Allouche et al. | |
| 7,044,237 | B2 | 5/2006 | Lechtenberg | |
| 9,506,337 | B2 * | 11/2016 | Smith | E21B 21/066 |
| 9,828,845 | B2 | 11/2017 | Kpetehoto et al. | |
| 10,954,729 | B2 | 3/2021 | Torrione | |
| 2006/0020390 | A1 | 1/2006 | Miller | |
| 2007/0215386 | A1 | 9/2007 | Burnett et al. | |
| 2008/0196942 | A1 | 8/2008 | Bingham et al. | |
| 2013/0054146 | A1 | 2/2013 | Rasmus et al. | |
| 2014/0020954 | A1 | 1/2014 | Pellertier et al. | |
| 2015/0013448 | A1 * | 1/2015 | Smith | E21B 49/005 73/152.46 |
| 2020/0326322 | A1 | 10/2020 | Farrukh Hamza | |
| 2020/0332654 | A1 | 10/2020 | Rowe et al. | |
| 2021/0324726 | A1 * | 10/2021 | Mahajan | E21B 44/04 |

OTHER PUBLICATIONS

Filing Receipt, Specification and Drawings for U.S. Appl. No. 63/191,722, entitled "System for Performing Comparison of Received Cuttings Weights From a Rig Site Cuttings Storage Unit and Expected Cuttings Weight Calculated Using Well Bore Geometry and Received Real Time Formation Density Data From LWD Tools," filed May 21, 2021, 57 pages.

Foreign Communication from Related Application—International Search Report and Written Opinion of the International Searching Authority, International Application No. PCT/US2022/015751, dated Jun. 2, 2022, 13 pages.

* cited by examiner

SYSTEM FOR PERFORMING COMPARISON OF RECEIVED CUTTINGS WEIGHTS FROM A RIG SITE CUTTINGS STORAGE UNIT AND EXPECTED CUTTINGS WEIGHT CALCULATED USING WELL BORE GEOMETRY AND RECEIVED REAL TIME FORMATION DENSITY DATA FROM LWD TOOLS

CROSS REFERENCE TO RELATED APPLICATIONS

This application claims priority to U.S. Provisional Application No. 63/191,722 filed May 21, 2021 and entitled "System for Performing Comparison of Received Cuttings Weights from a Rig Site Cuttings Storage Unit and Expected Cuttings Weight Calculated Using Well Bore Geometry and Received Real Time Formation Density Data from LWD Tools," which is incorporated by reference herein in its entirety.

BACKGROUND

Drilling boreholes for production of hydrocarbons, disposing fluids, and/or for sequestration of carbon dioxide poses many technical challenges. Different subterranean formations that are drilled into may have different qualities that affect drilling parameters. Obtaining timely and accurate downhole data for use in adapting drilling parameters can be challenging. In some drilling environments downhole conditions are desirably maintained within narrow operational limits.

BRIEF DESCRIPTION OF THE DRAWINGS

For a more complete understanding of the present disclosure and the advantages thereof, reference is now made to the following brief description, taken in connection with the accompanying drawings and detailed description, wherein like reference numerals represent like parts.

DETAILED DESCRIPTION

Figure 1:
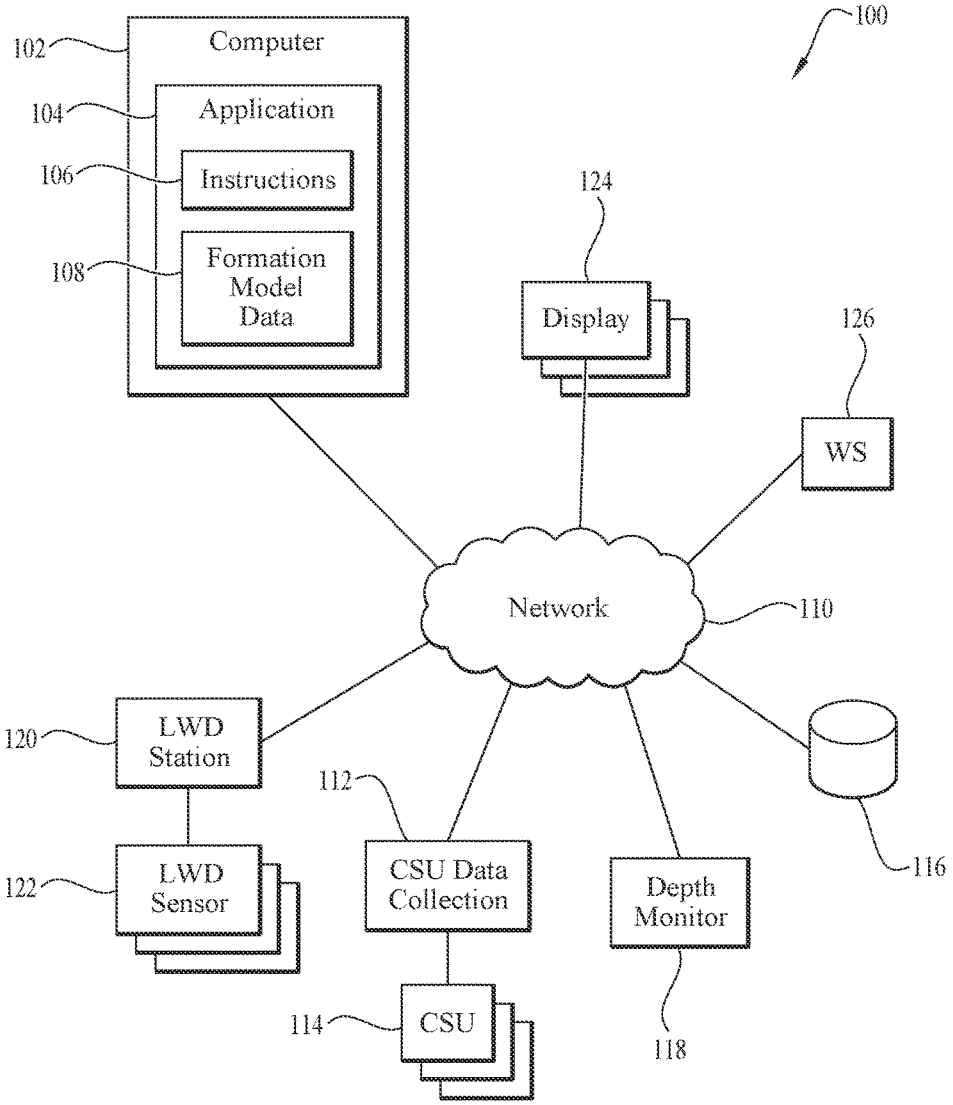
FIG. 1 is a block diagram of a system for determining received cuttings weight and expected cuttings weight and comparing the determined received cuttings weight with the expected cuttings weight whereby to adapt drilling of a borehole, according to an embodiment of the disclosure.

It should be understood at the outset that although an illustrative implementation of one or more embodiments are provided below, the disclosed systems and/or methods may be implemented using any number of techniques, whether currently known or in existence. The disclosure should in no way be limited to the illustrative implementations, drawings, and techniques illustrated below, including the exemplary designs and implementations illustrated and described herein, but may be modified within the scope of the appended claims along with their full scope of equivalents. As used herein, orientation terms such as "down" and "downhole" mean the direction from a surface into a wellbore towards the bottom of the wellbore and "up" and "uphole" mean the direction from the bottom of the wellbore towards the surface.

As a drill bit penetrates a subterranean formation during drilling, rock cuttings are produced. These cuttings are desirably removed by being swept to the surface carried in mud (e.g., drilling fluid) pumped from the surface, down a drill pipe string, out of the bit, and back up to the surface via an annulus defined between the drill pipe string and the inside of the borehole, liner, and/or casing. At the surface, the cuttings are separated from the mud by shaker separators, the cuttings are captured for disposal, and the mud is returned to the mud pits for circulation by a mud pump back into the wellbore. Removal of the cutting=s from a borehole and/or wellbore being drilled poses a variety of challenges. If the cuttings are not adequately cleaned from the borehole and/or wellbore, the cuttings can pack around the collars and other flow obstructions in a vertical wellbore or may stratify in a horizontal wellbore leading to possible stuck pipe. In the past timely and accurate downhole data on the cuttings was unavailable. As a result of this lack of data, either excessively conservative drilling parameters were used to avoid cuttings building up in the wellbore, which resulted in inefficient and/or slow drilling, or, if conservative drilling parameters were not used, sometimes cuttings built up excessively in the wellbore, resulting in lost time events such as stuck pipe or multiple bottom hole assembly (BHA) cleanout procedures would be performed (e.g., lost time events). This lack of timely and accurate downhole data, therefore, constitutes a problem for drilling. The present disclosure teaches a system that solves this problem and that provides accurate and timely data on cuttings production and cuttings removal that can be used to control and adapt drilling parameters in real-time. This system establishes, in effect, a closed loop control system, albeit the inputting of drilling parameters may be accomplished by a human worker. In future developments, drilling parameters may be adapted automatically by actuators controlled by the system, without human intervention.

The system taught herein determines received cuttings weight, determines expected cuttings weight, and presents the two different weight values in a readily interpretable format on one or more displays viewable by workers at a drilling rig. Said in other words, the system can present the data in an easily interpretable graphical display that can promote improved drilling operations and can show trend lines in real-time. Additionally, in an embodiment, the system can signal alarms when predefined operational thresholds are exceeded. Comparison of the two different weights provides insights into cuttings remaining in the wellbore. The insights into cuttings remaining in the wellbore can be used to adjust various drilling parameters. For example, if the comparison of cutting weights indicates the cuttings are not being cleaned well, drilling parameters can be adjusted to improve cleaning of cuttings (e.g., removal of cuttings from the wellbore, avoiding build up of cuttings in the wellbore). By contrast, if comparison of cutting weighs indicates cuttings are being cleaned more rapidly than necessary, drilling parameters may be adjusted to increase rate of drilling, which increases drilling efficiency, without causing any problems due to excessive cuttings build-up in the wellbore. Said in other words, the system promotes improved optimization of drilling parameters. The system may be reset or zeroed-out when each new section of wellbore is drilled.

Cuttings may be disposed in cutting storage units (CSUs) or tanks and removed from the rig for appropriate disposal at a different location, for example at an on-shore location when the wellbore and drilling rig are located off-shore. If CSU free capacity becomes unavailable, drilling may be stopped until CSU capacity becomes free. This may be a problem, for example, when weather prohibits disposal vessels approaching an off-shore rig to take away full CSUs and return empty CSUs. The system taught herein may provide accurate and timely indications of currently available free CSU capacity and indications, at a current rate of penetration (ROP) and given current cuttings remaining in the borehole, how long drilling may continue and/or how many more feet of hole may be made before free CSU capacity is exhausted. These indications of free CSU capacity and remaining drilling time and/or feet before free CSU capacity is exhausted may be presented on one or more displays viewable by drilling workers, for example a driller, a tool-pusher, and/or a company man. In an embodiment, the information provided by the system may be available to locations removed from the actual drilling site, for example available via telecommunication links to regional command centers, to home offices, to third-party vendors. For example, a third-party vendor may be responsible for retrieving full CSUs and returning empty CSUs to an off-shore rig. The CSU service may monitor the state of free CSU space, be aware of maritime conditions that prohibit approaching the off-shore rig in a boat, and may optionally return empty CSUs and retrieve full CSUs in a cargo-hearing helicopter.

The system comprises an application that executes on a computer system. The computer system may be one or more personal computers, one or more laptop computers, a rack server, or a cloud computing environment. The system may be located at the drilling rig or may be located away from the drilling rig and communicate with the rig via one or more telecommunication links. Computer systems are described further hereinafter. In an embodiment, the application may execute within a framework or execution environment provided by a data collection, data grooming, data storing, and data monitoring system executing on a computer.

The application receives inputs from one or more CSUs or from a CSU data collection station comprising received cuttings weight data. The received cuttings weight data may comprise a gross received cuttings weight and a net received cuttings weight. The net received cuttings weight may be determined by subtracting a weight of lubrication from the gross received cuttings weight. Lubrication may be added to the cuttings at the shaker separator to promote flow of cuttings from the shaker separator into the CSUs. The cuttings weight data may be tagged or associated with time information. The application can analyze the cuttings weight data and derive information from it. The application can derive changes of weight and associate various changed weights ("deltas") to a lagged return depth—an imputed depth value determined based on a calculated rate of flow of cuttings up the wellbore and based on a record of hole depth indexed by time. For example, if it is determined it takes 115 minutes for cuttings being received into the CSU to move up the wellbore, and the depth of drilling 115 minutes ago was 3,125 meters, then the lagged return depth associated with the cuttings delta just received is about 3,125 meters, although depth of drilling when the cuttings flow into the CSU may be at 3,128 meters. The received cuttings weight data may be stored indexed both by time and by lagged return depth values and stored in a data store. The received cuttings weight data may be provided to the application on a periodic interval, for example every 10 seconds, every 15 seconds, every 20 seconds, every 25 seconds, every 30 seconds, every 35 seconds, every 40 seconds, every 4.5 seconds, every 60 seconds, every 75 seconds, every 90 seconds, every 120 seconds, or some other periodic interval. In an embodiment, the application is triggered to process the received cuttings weight data by the event of receiving the data. In another embodiment, the application may periodically request the data from a CSU data collection station.

The application determines an expected cuttings weight delta based on a drill bit depth, based on a drill bit geometry, and based on a cuttings density value. For example, the application may perform this calculation periodically, for example every second, every 10 seconds, every 30 seconds, every minute, every two minutes, every five minutes, or at some other periodic interval. The area of the bit may be determined and multiplied by a change in drill bit depth over the subject period of analysis to determine a volume of cuttings made during the subject period. The volume of cuttings may be multiplied by the cuttings density value to determine the weight of the cuttings removed during the subject period of analysis. The area of the drill bit may be determined as the square of half the diameter of the drill bit multiplied by the irrational number pi ($\pi$— about 3.14159). In an embodiment, the drill bit diameter may be configured into the application or looked up by the application in a data store. In an embodiment, the application may learn the drill bit diameter from a data collection, data grooming, data storing, and data monitoring system framework within which it executes. The cuttings density value may be looked up in a formation density model stored as data within the application based on the current depth of drilling. Alternatively, the cuttings density value may be determined from logging while drilling (LWD) data supplied by an LWD monitoring station to the application, for example by neutron logging data and/or by gamma ray logging data. The expected cuttings weight values are indexed by the application by time and by depth. In this case the depth is not a lagged depth value, because the data is a calculated or expected value and the depth associated with that value is known.

LWD data may not be available to the application at various times. For example, when starting drilling in a new section of the wellbore, LWD data may not be available for an extended period of time. The LWD sensors may not be located close to the drill bit in the drill string, and hence the cuttings will not propagate to the vicinity of the LWD sensors immediately. In the absence of LWD data on cuttings density, the modeled cuttings density value is used to determine expected cuttings weight. In an embodiment, expected cuttings weight values that were determined using modeled cuttings density values may be re-calculated or re-determined using the LWD cuttings density values when it becomes available. If the modeled cuttings density value differs from the LWD cuttings density value by less than a predefined amount, the expected cutting weight values are not redetermined. If the modeled cuttings density value differs from the LWD cuttings density value by the predefined amount or more, the expected cutting weight values are redetermined based on the LWD cuttings density value and various derived expected cuttings weight values (e.g., accumulated expected cuttings weight since starting drilling in the section) are updated accordingly.

The application can calculate accumulated expected cuttings weight values by summing each periodically determined expected cuttings weight. The accumulated expected cuttings weight value can be reset or zeroed at the start of drilling a section of the wellbore. Likewise the received cuttings weight can be zeroed at the start of drilling a section of the wellbore, even if the CSUs themselves are not in fact emptied (e.g., a tare weight initial value can be determined on reset and used to effectively zero the CSU data). In an embodiment, a section of the wellbore may be a length of the wellbore that was drilled as a contiguous open hole before installing casing or liner in this length of open hole. Thus, a wellbore may comprise a series of sections drilled and cased or lined and then drilled some more and then cased or lined, optionally with a final length of open hole at the bottom of the borehole. The comparison between the received cuttings weight and the expected cuttings weight gives a good idea of how much cuttings remain in the wellbore since initiating drilling in a section. Since the accumulated expected cuttings include all the cuttings made in the section up to a current time, the difference is how much cuttings have not yet been received at the surface.

Drilling parameters that can be adapted based on the comparison between expected cuttings weight and received cuttings weight comprise weight on bit, rate of penetration (ROP), rate of revolution of the bit, a pump output pressure, a pump output flow rate, a mud weight or density, and a mud viscosity. Actions or procedures that can be undertaken based on the comparison between expected cuttings weight and received cuttings weight comprise circulating a pill down the drill pipe and up the annulus to perform a cleaning operation and adapting a direction of drilling. In some circumstances, a collapsing hole condition or a hole washout condition may be detected if a received cuttings weight exceeds an expected cuttings weight by more than a predefined threshold. In an embodiment, the system may promote comparing received cuttings weight to accumulated expected cuttings weight having a depth value that matches the lagged depth value of the currently received cuttings. In this case, receiving more cuttings weight than accumulated cuttings weight may be explained by receiving additional material from borehole walls and subterranean formation material from adjacent the borehole. On inferring such borehole collapse from this data, drilling parameters may be at least transiently adapted to arrest further collapse of the borehole walls and to mitigate the risk of future collapse of the borehole walls.

Turning now to FIG. 1, a system 100 is described. In an embodiment, the system 100 comprises a computer 102 that executes an application 104 that comprises executable instructions 106 or logic and formation model data 108. The application 104 may be stored in a non-transitory memory of the computer 102. The computer 102 and the application 104 are communicatively coupled to a network 110. The computer 102 is communicatively coupled via the network 110 to a cuttings storage unit (CSU) data collection station 112. The CSU data collection station 112 is communicatively coupled to one or more CSUs 114, for example to weight load cell sensors associated with the CSUs 114. The computer 102 is communicatively coupled via the network 110 to a data store 116, to a depth monitor 118, and to a logging while drilling (LWD) monitor station 120. The depth monitor 118 simply indicates a current depth of the drill bit and/or the bottom of the wellbore. The LWD monitor station 120 is communicatively coupled to one or more LWD sensors 122 coupled to a drill string. The LWD monitor station 120 may communicate with the LWD sensors 122 by mud pulse telephony, by wired communication link, or by wireless communication link. The computer 102 is communicatively coupled via the network 110 to one or more displays 124 and to at least one work station 126. The network 110 may comprise one or more private networks, one or more public networks, or a combination thereof.

The communication link from the computer 102 to the network 110 may be a wireless communication link or a wired communication link. The communication link between the network 110 and the CSU data collection station 112 may be a wireless communication link or a wired communication link. The communication link between the network 110 and the LWD monitor station 120 may be a wireless communication link or a wired communication link. The communication link between the network 110 and the depth monitor 118 may be a wireless communication link or a wired communication link. The communication links between the network 110 and the displays 124 may be wireless communication links and/or wired communication links. The communication link between the network 110 and the work station 126 may be a wireless communication link or a wired communication link. In an embodiment, the computer 102 is located in the drilling rig environment, at a wellbore location. In an embodiment, the application 104 executes on a computer 102 that is removed from the drilling rig environment, for example located at a regional office or at a home office. In an embodiment, the application 104 may be disposed within a framework or execution environment provided by a data collection, data grooming, data storing, and data monitoring system executing on the computer 102.

The displays 124 may be located at various locations in a drilling rig environment, for example in a dog house, in a tool-pusher office, in a mud shack, and other locations. One or more of the displays 124 may be remote from the wellbore location, for example at a regional office or at a home office of an energy company or drilling company. The work station 126 may be located in the drilling environment or remotely located at a regional office or at a home office of a drilling company. The displays may be used by rig workers to monitor the drilling conditions and adapt drilling parameters. For example, a driller, a tool-pusher, and/or a company man (e.g., representative of the energy company) may inform themselves of wellbore conditions and received cuttings conditions, in part, based on looking at representations of the cuttings weight data presented on the displays 124. The work station 126 may be used by a mud logger or computer specialist to control the execution of the application 104 and/or to configure the application 104.

Figure 2:
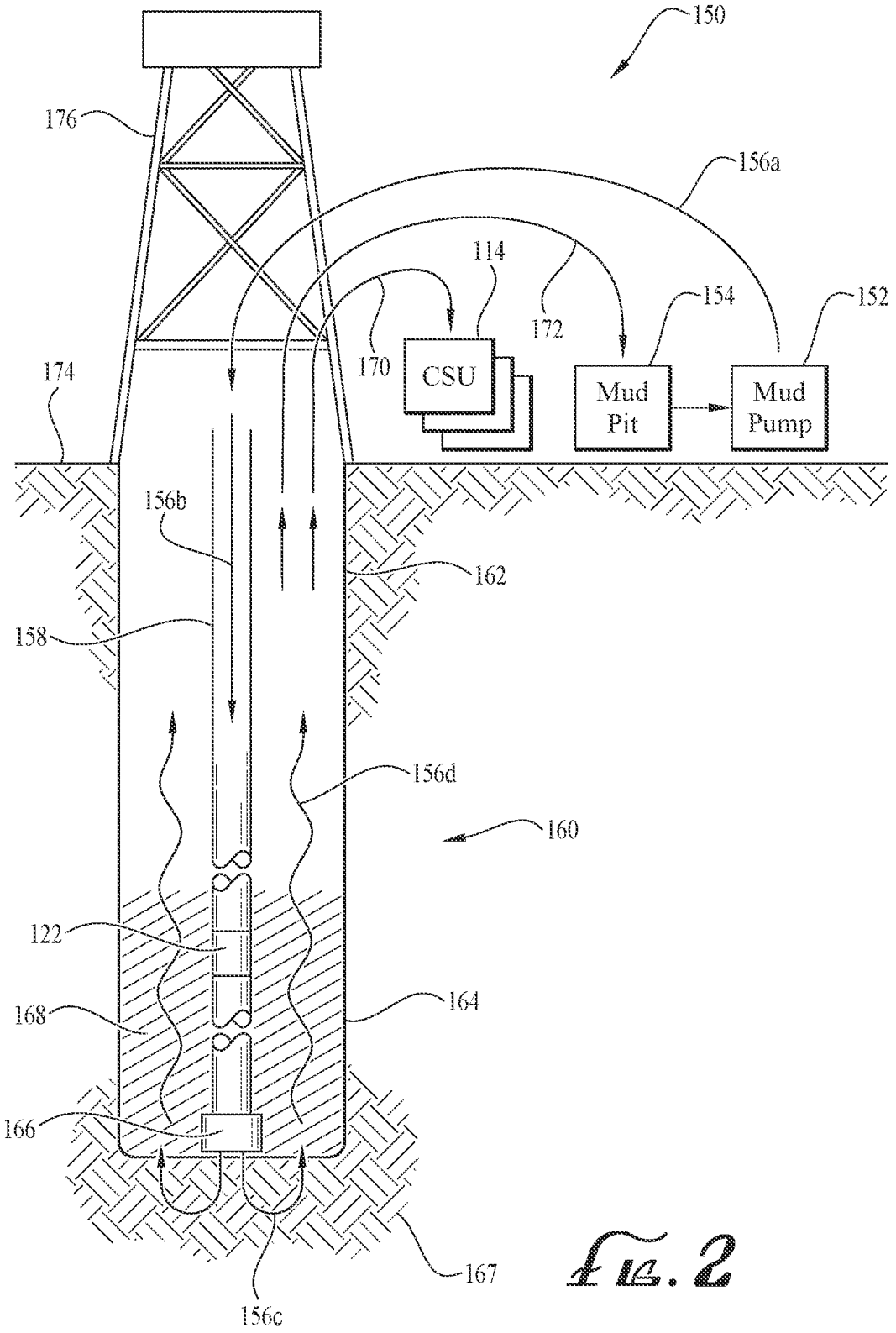
FIG. 2 is an illustration of a borehole and drilling rig according to an embodiment of the disclosure.

Turning now to FIG. 2, an illustration of a drilling rig environment 150 is described. In an embodiment, the system 100 described above is located, at least in part, in the drilling rig environment 150. In an embodiment, the drilling rig environment 150 comprises a plurality of CSUs 114 and one or more mud pumps 152 that receive mud from one or more mud pits 154. The mud pump 152 provides mud flow 156*a* into a drill string 158 as mud flow 156*b*. The mud flow 156*b* flows downhole in the drill string 158, out of the drill bit 166 as mud flow 156*c*. The mud flow 156*c* rises in the hole as mud flow 156*d* carrying cuttings 168 produced by the drill bit 166 drilling into a subterranean formation 167 up a borehole 164, up a liner or casing 162, to a surface 174. The wellbore 160 comprises an open hole of the borehole 164 (e.g., a section currently being drilled) and a series of liners and/or casing 162. The mud flow 156*d* exits an annulus formed between the drill string 158 and the wellbore 160 and is separated by a shaker separator (not shown) at the surface 174.

Cuttings flow 170 is directed to the CSUs 114; mud flow 172 is returned to the mud pits 154. The drill string 158 comprises the LWD sensors 122 located some distance uphole from the drill bit 166. In an embodiment, the LWD sensors 122 are located below the surface 174 and 20 feet or more, 40 feet or more, 60 feet or more, 80 feet or more, 100 feet or more, 130 feet or more, 160 feet or more, 200 feet or more, 250 feet or more, 300 feet or more, 350 feet or more, 400 feet or more, 500 feet or more, 600 feet or more, 700 feet or more, 800 feet or more, 900 feet or more, 1000 feet or more, 1500 feet or more, and less than 10,000 feet uphole from the drill bit 166. In an embodiment, the LWD sensors 122 may be located below the surface 174 and some other distance uphole from the drill bit 166.

The drilling rig environment 150 comprises a mast structure 176 that supports lifting apparatus such as crown block and traveling block that may be used to support and lift the drill string 158 as well as for running casing and liners. The mast structure 176 may support a floor which retains a rotary table that may rotate the drill string 158 whereby to turn the drilling bit 166 on the bottom of the wellbore 160. It is understood that this is a simplified depiction and description of a drilling rig environment and that there are many other tools and implements and structures that may be part of the rig environment that are not described herein.

Figure 3:
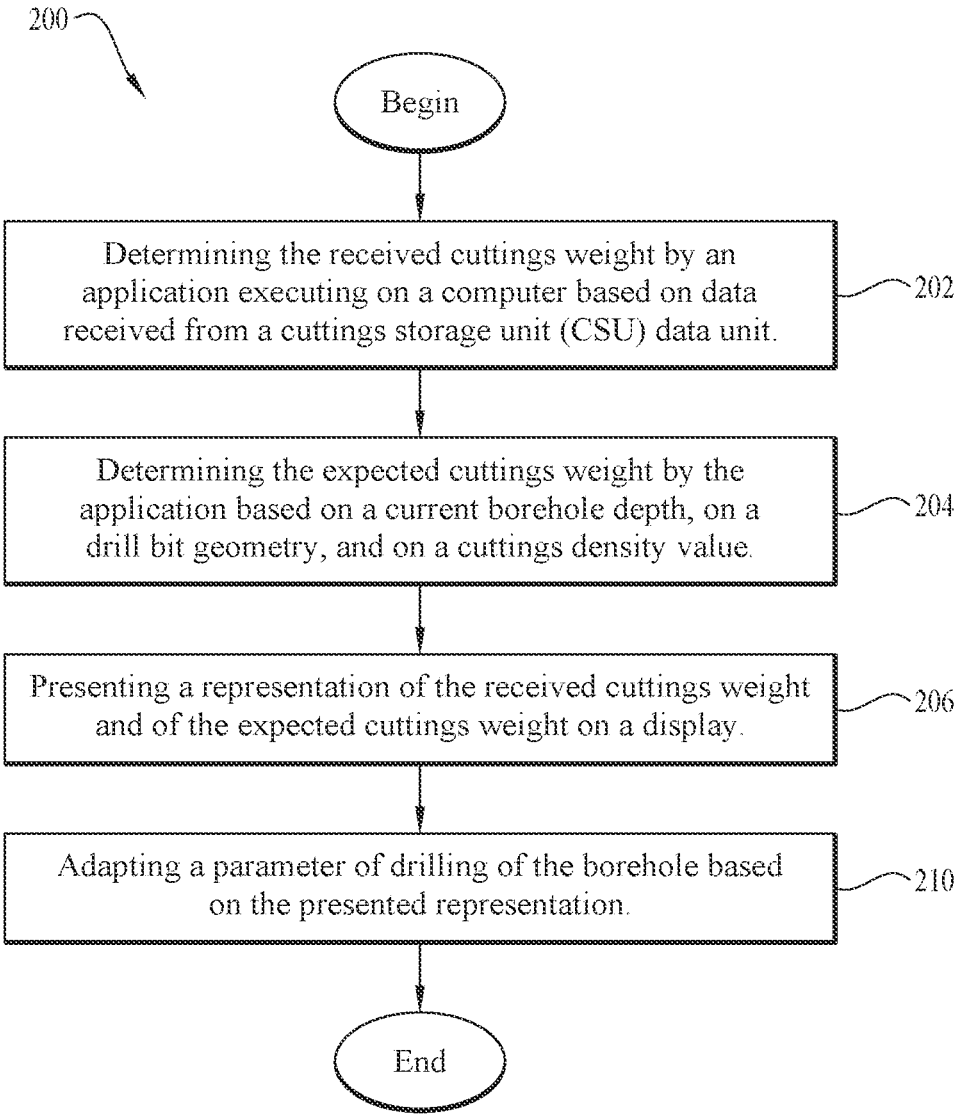
FIG. 3 is a flow chart of a method of adapting drilling of a borehole in a subterranean formation based on comparing a received cuttings weight to an expected cuttings weight according to an embodiment of the disclosure.

Turning now to FIG. 3, a method 200 is described. In an embodiment, the method 200 comprises a method of adapting drilling of a borehole in a subterranean formation based on comparing a received cuttings weight to an expected cuttings weight. At block 202, the method 200 comprises determining the received cuttings weight by an application executing on a computer based on data received from a cuttings storage unit (CSU) data collection station. In an embodiment, the received cuttings weight data is created by the CSU data col lection station 112 described above with reference to FIG. 1. The CSU data collection station 112 may provide data for each of a plurality of separate CSUs 114. The CSU data collection station 112 may receive load cell weight sensor signals from load cells mechanically coupled to each of the CSUs 114 and process these signals to generate received cuttings weight data. In an embodiment, the CSU data collection station 112 may smooth, filter, and/or average sensor signals received from load cells. The CSU data collection station 112 may translate raw load cell sensor signal values to customary weight or mass unit values. The CSU data collection station 112 may sum together weight data provided by two or more load sensors mechanically coupled to the same CSU 114. In an embodiment, the application 104 may determine weight deltas and store the weight deltas and received cuttings weight data in the data store 116 along with a time stamp and along with a lagged depth value.

At block 204, the method 200 comprises determining the expected cuttings weight by the application based on a current borehole depth, on a drill bit geometry, and on a cuttings density value. The expected cuttings weight may be determined as a sum of a plurality of expected cuttings weight deltas or increments. For example, the application may calculate the weight of cuttings produced by drilling during a predefined time interval such as 1 second, 5 seconds, 10 seconds, 15 seconds, 20 seconds, 25 seconds, 30 seconds, 35 seconds, 45 seconds, 60 seconds, 90 seconds, 120 seconds, or some other time interval. By adding the expected cuttings associated with each of a plurality of analysis intervals, the total expected weight of cuttings produced during drilling from the start of a section of the wellbore 160 may be determined.

The expected cuttings weight during a time interval can be determined by the application 104 by multiplying a volume drilled during the time interval by a cuttings density value. The volume drilled can be determined by multiplying an area of the drill bit contact with the bottom of the wellbore 160 by the distance drilled during the time interval. The area of the drill bit contact with the bottom of the hole may be determined by multiplying the irrational number pi ($\pi$—about 3.14159) with the square of the radius of the drill bit 166. The radius of the drill bit 166 can be found as half the diameter of the drill bit 166. The diameter of the drill bit 166 may be configured into the application 104, the application 104 may look up the diameter of the drill bit 166 in the data store 116, or the application 104 may learn the diameter of the drill bit 166 from a data collection, data grooming, data storing, and data monitoring system. When cuttings density data is not provided by the LWD sensors 122 and/or the LWD monitor station 120, the application 104 may use a cuttings density value looked up in the formation model data 108 using the wellbore depth at the time of the calculation (or the wellbore depth at the middle of the time interval being analyzed) as an index. The formation model data 108 may be stored as data in the application 104 and may be configured for each different wellbore 160 and/or for each different drilling region. In an embodiment, the cuttings density value may be looked up in the formation model data 108 using a true depth determined based on the wellbore depth (e.g., the length of the wellbore 162) and based on a azimuth and elevation of the drilling trajectory at different times. For example, in inclined and/or horizontal wellbores, true depth may not match to wellbore depth.

When the cuttings density value is available from the LWD monitor station 120 or the LWD sensors 122, this value may be used in determining the expected cuttings weight delta. Cuttings weight deltas may be summed to arrive at a total expected cuttings weight or an accumulated expected cuttings weight created during the drilling of a current section of the wellbore 160. The expected cuttings weight values may be reset, cleared, or zeroed before starting drilling a new section of the wellbore 160. When the cuttings density value becomes available from the LWD monitor station 120 or the LWD sensors 122, the application 104 may recalculate the expected cuttings weight deltas for each of the analysis intervals of the current section of drilling and determine the total or accumulated expected cuttings weight and use this information as being more accurate than the expected cuttings weight values calculated based on the formation model data 108. In an embodiment, before recalculation, the cuttings density value provided by the LWD sensors 122 and/or the LWD monitor station 120 is compared to the cuttings density value looked up in the formation model data 108. If the difference between these density values is below a threshold, the recalculations are not performed. If the difference between the density values is at or above the threshold, the recalculations are performed. The expected cuttings weight values—accumulated expected cuttings weight value and expected cuttings weight delta values—may be associated with time and with the depth associated with their analysis interval and stored by the application 104 in the data store 116.

At block 206, the method 200 comprises presenting a representation of the received cuttings weight and a representation of the expected cuttings weight on a display. In an embodiment, the representation of received cuttings weight is presented versus time in an X-Y plot format. In an embodiment, the representation of received cuttings weight is presented versus lagged depth in an X-Y plot format. In an embodiment, the representation of expected cuttings weight is presented versus time in an X-Y plot format. In an embodiment, the representation of expected cuttings weight is presented versus depth in an X-Y plot. In an embodiment, the representations of received cuttings weight and the representations of expected cuttings weight are presented in a rose-type format. In an embodiment, the representations are presented in a polygon format. In an embodiment, a plurality of representations of received cuttings weight and expected cuttings weight are superimposed over each other to show a time-sequence of representations, with earlier representations being behind or under later representations. These representations of data are discussed further hereinafter. A plurality of displays that may be employed in one or more embodiments are discussed further below with reference to FIG. 5, FIG. 6, FIG. 7, FIG. 8, FIG. 9, FIG. 10, FIG. 11, and FIG. 12.

At block 208, the method 200 comprises adapting a parameter of drilling of the borehole based on comparing the representation of the received cuttings weight to the representation of the expected cuttings weight. The visual investigation of the presentation of the representations of received cuttings weight and of expected cuttings weight can reveal much about downhole conditions to drillers, tool-pushers, company men, and other drilling rig workers. The implications of these exhibited downhole conditions may cause the rig workers to change the drilling parameters. This may entail one or more of changing the weight on bit, changing the rate of penetration (ROP), changing the rotational speed of the drill bit on bottom, changing the mud pump output pressure, changing the mud pump output flow rate, changing the mud weight or density, changing the mud viscosity. This may entail building and pumping a pill downhole through the drill string 158 to clean the wellbore 160. This may entail changing the mud chemistry by increasing or decreasing chemicals added into the mud.

In an embodiment, the received cuttings weight can be compared to the expected cuttings weight by the application 104, and the application 104 can automatically adapt drilling parameters, for example by sending control outputs to actuators coupled to equipment in the rig environment 150. In an embodiment, the application 104 can compare an accumulated expected cuttings weight associated with a specific depth to an accumulated received cuttings weight associated with a lagged depth that is equal to the specific depth associated with the accumulated expected cuttings weight.

Figure 4:
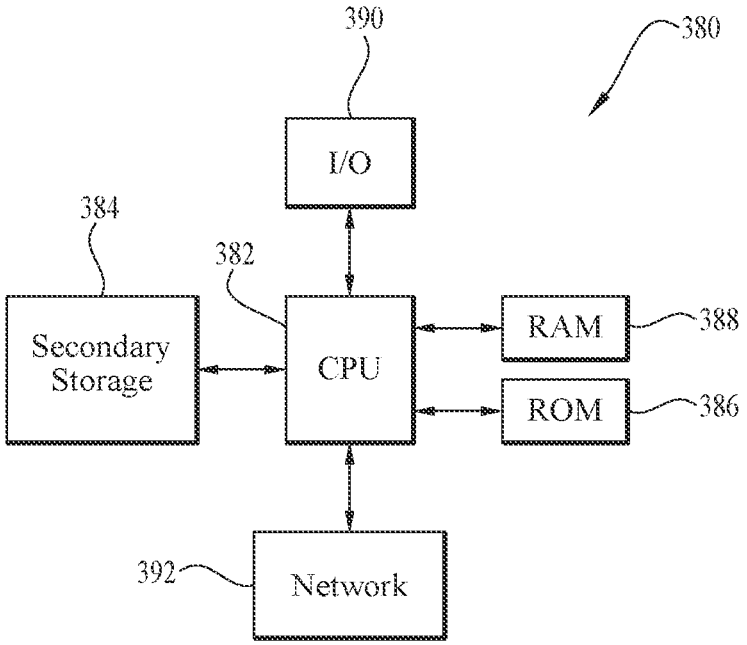
FIG. 4 is a block diagram of a computer system according to an embodiment of the disclosure.

FIG. 4 illustrates a computer system 380 suitable for implementing one or more embodiments disclosed herein. For example, in an embodiment, the computer 102 may be implemented in a form similar to that of computer system 380. In an embodiment, the LWD monitor station 120 may be implemented in a form similar to that of computer system 380. In an embodiment, the CSU data collection station 112 may be implemented in a form similar to that of computer system 380. The computer system 380 includes a processor 382 (which may be referred to as a central processor unit or CPU) that is in communication with memory devices including secondary storage 384, read only memory (ROM) 386, random access memory (RAM) 388, input/output (I/O) devices 390, and network connectivity devices 392. The processor 382 may be implemented as one or more CPU chips.

It is understood that by programming and/or loading executable instructions onto the computer system 380, at least one of the CPU 382, the RAM 388, and the ROM 386 are changed, transforming the computer system 380 in part into a particular machine or apparatus having the novel functionality taught by the present disclosure. It is fundamental to the electrical engineering and software engineering arts that functionality that can be implemented by loading executable software into a computer can be converted to a hardware implementation by well-known design rules. Decisions between implementing a concept in software versus hardware typically hinge on considerations of stability of the design and numbers of units to be produced rather than any issues involved in translating from the software domain to the hardware domain. Generally, a design that is still subject to frequent change may be preferred to be implemented in software, because re-spinning a hardware implementation is more expensive than re-spinning a software design. Generally, a design that is stable that will be produced in large volume may be preferred to be implemented in hardware, for example in an application specific integrated circuit (AMC), because for large production runs the hardware implementation may be less expensive than the software implementation. Often a design may be developed and tested in a software form and later transformed, by well-known design rules, to an equivalent hardware implementation in an application specific integrated circuit that hardwires the instructions of the software. In the same manner as a machine controlled by a new ASIC is a particular machine or apparatus, likewise a computer that has been programmed and/or loaded with executable instructions may be viewed as a particular machine or apparatus.

Additionally, after the system 380 is turned on or booted, the CPU 382 may execute a computer program or application. For example, the CPU 382 may execute software or firmware stored in the ROM 386 or stored in the RAM 388. In some cases, on boot and/or when the application is initiated, the CPU 382 may copy the application or portions of the application from the secondary storage 384 to the RAM 388 or to memory space within the CPU 382 itself, and the CPU 382 may then execute instructions that the application is comprised of. In some cases, the CPU 382 may copy the application or portions of the application from memory accessed via the network connectivity devices 392 or via the I/O devices 390 to the RAM 388 or to memory space within the CPU 382, and the CPU 382 may then execute instructions that the application is comprised of. During execution, an application may load instructions into the CPU 382, for example load some of the instructions of the application into a cache of the CPU 382. In some contexts, an application that is executed may be said to configure the CPU 382 to do something, e.g., to configure the CPU 382 to perform the function or functions promoted by the subject application. When the CPU 382 is configured in this way by the application, the CPU 382 becomes a specific purpose computer or a specific purpose machine.

The secondary storage 384 is typically comprised of one or more disk drives or tape drives and is used for non-volatile storage of data and as an over-flow data storage device if RAM 388 is not large enough to hold all working data. Secondary storage 384 may be used to store programs which are loaded into RAM 388 when such programs are selected for execution. The ROM 386 is used to store instructions and perhaps data which are read during program execution. ROM 386 is a non-volatile memory device which typically has a small memory capacity relative to the larger memory capacity of secondary storage 384. The RAM 388 is used to store volatile data and perhaps to store instructions. Access to both ROM 386 and RAM 388 is typically faster than to secondary storage 384. The secondary storage 384, the RAM 388, and/or the ROM 386 may be referred to in some contexts as computer readable storage media and/or non-transitory computer readable media.

I/O devices 390 may include printers, video monitors, liquid crystal displays (LCDs), touch screen displays, keyboards, keypads, switches, dials, mice, track balls, voice recognizers, card readers, paper tape readers, or other well-known input devices.

The network connectivity devices 392 may take the form of modems, modem banks, Ethernet cards, universal serial bus (USB) interface cards, serial interfaces, token ring cards, fiber distributed data interface (FDDI) cards, wireless local area network (WLAN) cards, radio transceiver cards, and/or other well-known network devices. The network connectivity devices 392 may provide wired communication links and/or wireless communication links (e.g., a first network connectivity device 392 may provide a wired communication link and a second network connectivity device 392 may provide a wireless communication link). Wired communication links may be provided in accordance with Ethernet (IEEE 802.3), Internet protocol (IP), time division multiplex (TDM), data over cable service interface specification (DOCSIS), wavelength division multiplexing (WDM), and/or the like. In an embodiment, the radio transceiver cards may provide wireless communication links using protocols such as code division multiple access (CDMA), global system for mobile communications (GSM), long-term evolution (LTE), WiFi (IEEE 802.11), Bluetooth, Zigbee, narrowband Internet of things (NB toT), near field communications (NFC), radio frequency identity (RFID). The radio transceiver cards may promote radio communications using 5G, 5G New Radio, or 5G LTE radio communication protocols. These network connectivity devices 392 may enable the processor 382 to communicate with the Internet or one or more intranets. With such a network connection, it is contemplated that the processor 382 might receive information from the network, or might output information to the network in the course of performing the above-described method steps. Such information, which is often represented as a sequence of instructions to be executed using processor 382, may be received from and outputted to the network, for example, in the form of a computer data signal embodied in a carrier wave.

Such information, which may include data or instructions to be executed using processor 382 for example, may be received from and outputted to the network, for example, in the form of a computer data baseband signal or signal embodied in a carrier wave. The baseband signal or signal embedded in the carrier wave, or other types of signals currently used or hereafter developed, may be generated according to several methods well-known to one skilled in the art. The baseband signal and/or signal embedded in the carrier wave may be referred to in some contexts as a transitory signal.

The processor 382 executes instructions, codes, computer programs, scripts which it accesses from hard disk, floppy disk, optical disk (these various disk based systems may all be considered secondary storage 384), flash drive, ROM 386, RAM 388, or the network connectivity devices 392. While only one processor 382 is shown, multiple processors may be present. Thus, while instructions may be discussed as executed by a processor, the instructions may be executed simultaneously, serially, or otherwise executed by one or multiple processors. Instructions, codes, computer programs, scripts, and/or data that may be accessed from the secondary storage 384, for example, hard drives, floppy disks, optical disks, and/or other device, the ROM 386, and/or the RAM 388 may be referred to in some contexts as non-transitory instructions and/or non-transitory information.

In an embodiment, the computer system 380 may comprise two or more computers in communication with each other that collaborate to perform a task. For example, but not by way of limitation, an application may be partitioned in such a way as to permit concurrent and/or parallel processing of the instructions of the application. Alternatively, the data processed by the application may be partitioned in such a way as to permit concurrent and/or parallel processing of different portions of a data set by the two or more computers. In an embodiment, virtualization software may be employed by the computer system 380 to provide the functionality of a number of servers that is not directly bound to the number of computers in the computer system 380. For example, virtualization software may provide twenty virtual servers on four physical computers. In an embodiment, the functionality disclosed above may be provided by executing the application and/or applications in a cloud computing environment. Cloud computing may comprise providing computing services via a network connection using dynamically scalable computing resources. Cloud computing may be supported, at least in part, by virtualization software. A cloud computing environment may be established by an enterprise and/or may be hired on an as-needed basis from a third-party provider. Some cloud computing environments may comprise cloud computing resources owned and operated by the enterprise as well as cloud computing resources hired and/or leased from a third-party provider.

In an embodiment, some or all of the functionality disclosed above may be provided as a computer program product. The computer program product may comprise one or more computer readable storage medium having computer usable program code embodied therein to implement the functionality disclosed above. The computer program product may comprise data structures, executable instructions, and other computer usable program code. The computer program product may be embodied in removable computer storage media and/or non-removable computer storage media. The removable computer readable storage medium may comprise, without limitation, a paper tape, a magnetic tape, magnetic disk, an optical disk, a solid-state memory chip, for example analog magnetic tape, compact disk read only memory (CD-ROM) disks, floppy disks, jump drives, digital cards, multimedia cards, and others. The computer program product may be suitable for loading, by the computer system 380, at least portions of the contents of the computer program product to the secondary storage 384, to the ROM 386, to the RAM 388, and/or to other non-volatile memory and volatile memory of the computer system 380. The processor 382 may process the executable instructions and/or data structures in part by directly accessing the computer program product, for example by reading from a CD-ROM disk inserted into a disk drive peripheral of the computer system 380. Alternatively, the processor 382 may process the executable instructions and/or data structures by remotely accessing the computer program product, for example by downloading the executable instructions and/or data structures from a remote server through the network connectivity devices 392. The computer program product may comprise instructions that promote the loading and/or copying of data, data structures, files, and/or executable instructions to the secondary storage 384, to the ROM 386, to the RAM 388, and/or to other non-volatile memory and volatile memory of the computer system 380.

In some contexts, the secondary storage 384, the ROM 386, and the RAM 388 may be referred to as a non-transitory computer readable medium or a computer readable storage media. A dynamic RAM embodiment of the RAM 388, likewise, may be referred to as a non-transitory computer readable medium in that while the dynamic RAM receives electrical power and is operated in accordance with its design, for example during a period of time during which the computer system 380 is turned on and operational, the dynamic RAM stores information that is written to it. Similarly, the processor 382 may comprise an internal RAM, an internal ROM, a cache memory, and/or other internal non-transitory storage blocks, sections, or components that may be referred to in some contexts as non-transitory computer readable media or computer readable storage media.

The present disclosure relates to a system 100 to accurately correlate the measured weight of returned cuttings from a wellbore against the calculated cuttings weight. The cuttings weight may be calculated using recorded bulk density of rock and volume of rock removed. No off-the-shelf solution exists to calculate and determine the weight of cuttings removed using real-time logging while drilling (LWD) formation density data and compare against live data from a cutting storage unit.

The challenge addressed by the teachings of this disclosure is to promote rig personnel to visualize this data in an easily interpretable graphical display showing trend lines in real-time. This may be displayed against both independent variables of Time and Lagged returns depth. Examples of possible display screens are discussed below with reference to FIG. 5, FIG. 6, FIG. 7, FIG. 8, FIG. 9, FIG. 10, and FIG. 11. It is understood, however that other different screens that present cuttings weight data are also be used.

The system 100 will record live data received from weight cells installed on cuttings storage units (CSUs) 114 or other storage units and plot the trends against a derived calculation of weight of cuttings based on logging while drilling (LWD) formation density data.

Figure 5:
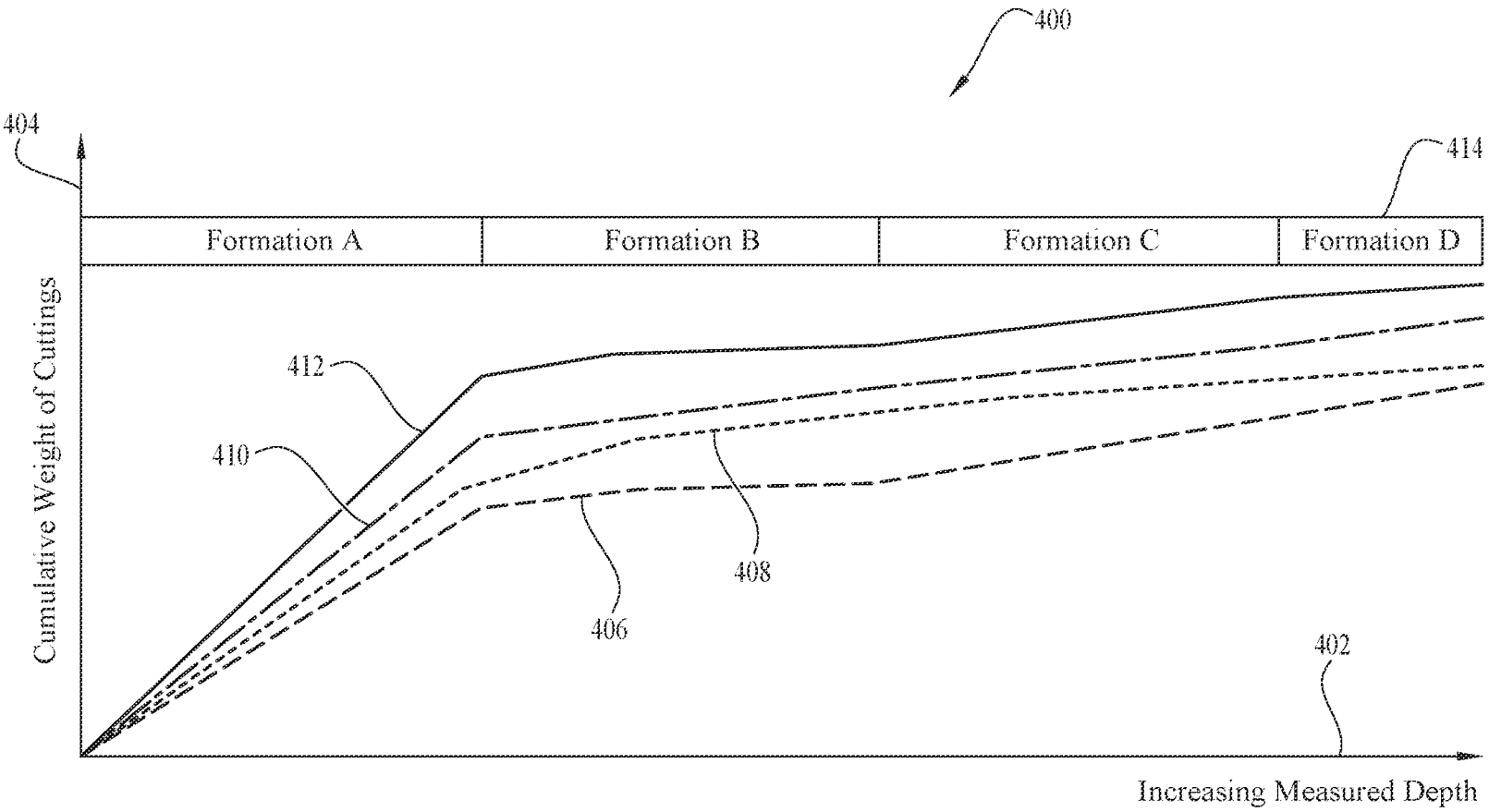
FIG. 5 is a process flow diagram for a system for perforating comparison of received cutting weights from a rig site cutting storage unit and expected cutting weight calculated using well bore geometry and received real-time formation density data from LWD tools according to an embodiment of the disclosure.
Figure 6:
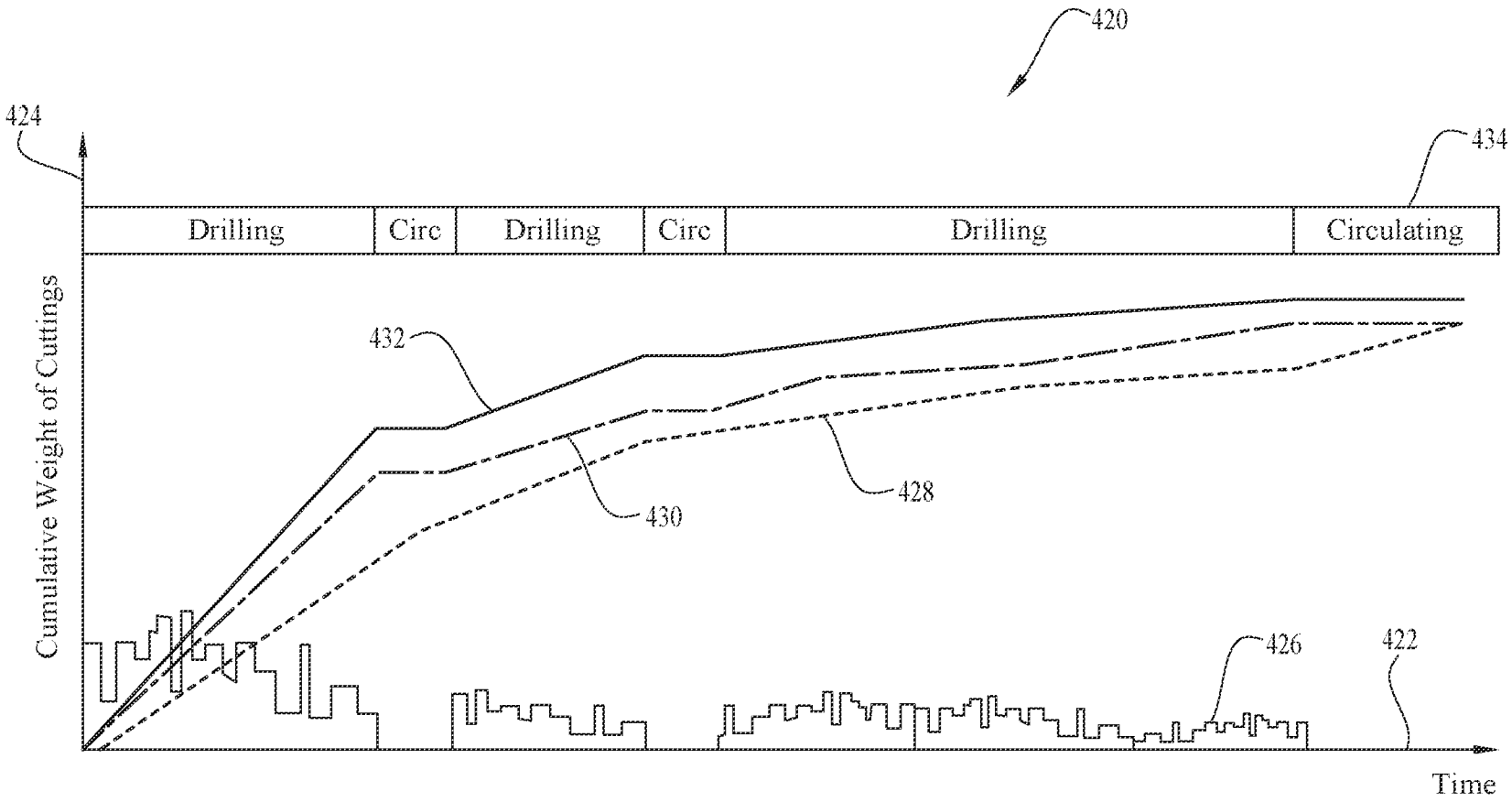
FIG. 6 is a diagram of CSU (Cutting Storage Unit) Inputs according to an embodiment of the disclosure.

The application 104 can display the data as a graphical trend against both time (as an example see FIG. 5) and lagged return depth (as an example see FIG. 6).

The present disclosure teaches digital displays and alarms including tank displays, operational limits and rose diagrams to help determine the condition of the wellbore in real-time and/or near real-time. The deviation value between the two trends will be generated and written to the database. This value will be alarmed within the application 104 to alert users to a change in expected cuttings return values.

The present disclosure teaches a system that provides real-time and/or near real-time comparison of data from two key sources to aid in hole cleaning determinations to improve drilling efficiencies.

The present disclosure also teaches a system that provides real-time and/or near real-time transmitted data from cutting storage units (CSUs) 114, also known as bulk cutting tanks or skips.

Real-time data from logging while drilling formation density data to convert cutting volumes into a cutting weight in real-time.

The operator of the system taught herein (e.g., computer 102 and application 104) can provide real-time cuttings removal data to a drilling company and/or to an energy company (e.g., the customer).

Using Live Cuttings weight monitoring data and performing comparison to the expected calculated cuttings weight using multiple sources of data including drilling and circulating data, real-time formation density data and received weight from cutting storage units will provide key outcomes and solutions.

CSU (Cutting Storage Unit)— A storage unit located at a rig site (offshore or onshore) capable of storing drilled cuttings removed from a well through a returned drilling circulation system.

CSU Weight—Individual weight of a specified CSU.

Cumulative Gross Weight/Gross Total CSU— Total weight of all CSUs being used for cuttings storage.

Cumulative. NET Weight/NET Total CSU Cumulative Gross Weight minus lubricant added to CSUs. (Lubricant added to aid cuttings flow from shakers to CSUs).

Initial Cumulative Calculated Weight removed—Weight derived from bit diameter, interval drilled and formation density data from either LWD tools or pre-well modelling.

LWD Adjusted Cumulative Calculated Weight removed—Weight derived from wellbore geometry (volume) and formation density data (density) received from a downhole LWD tool.

The system taught by the present disclosure provides more accurate data for role cleaning leading to increasing efficiency during drilling and circulating operations.

Reduction in lost time events following drilling runs.

Better success case for casing and liner runs.

Remove need for specific clean out BHA runs.

More details on borehole stability conditions downhole.

Key operational data and limitations displayed in real-time.

The system taught by the present disclosure provides a solution that will input data from multiple sources to provide the calculations. The system will input data from the following sources:

1. Surface Data Logger (SDL) Inputs:
   a. Lagged Return Depth
   b. Pump rates and pump specifications
   c. ROP
   d. Bit diameter
   e. Wellbore geometry to provide annulus volume
2. Cutting Storage unit
   a. Individual Cutting Storage Unit Weights
   b. Cumulative Total Cutting Weight (Gross Weight)
   c. Cumulative Total Cutting Weight (NET Weight)=Gross Weight; Lubrication added to cuttings removal system d. Lubricant flow rate
e. Mass flow cuttings 3. Formation Density Data
f. Static modelled formation density data for a specific section
g. Live real-time formation density data provided by either Halliburton LWD tool or third-party service provider. Density data must be tagged with a measured depth.

As cuttings are drilled, they are tracked through the annulus using the annular volume and flow rate of the drilling fluid. When the cuttings are calculated to have arrived at surface the lagged return depth updates to notify the software when cuttings are arriving at surface.

In an embodiment, the cuttings weight data from cutting storage unit(s), formation density data, drilling and circulating data, and wellbore geometry data are processed by the application 104 to determine cuttings circulated out of the annulus in real-time, cuttings remaining in the annulus in real-time, available cuttings storage capacity and operational limits in real-time, and generates alarms as appropriate.

A system (e.g., the computer 102 executing application 104 described above with reference to FIG. 1) for performing comparison of received cutting weights from a rig site cutting storage unit and expected cuttings weight are calculated using well bore geometry and received real-time formation density data from LWD tools (e.g., from LWD sensors 122 and/or LWD monitor station 120) is shown. Cutting weight data from the cutting storage unit (e.g., from the CSU data collection station 112 and/or CSUs 114), formation density data, drilling and circulating data and wellbore geometry data are run through a real-time cutting weight application (e.g., application 104 executing on computer 102). The real-time cutting weight application outputs RT cuttings circulated out of the annulus, RT cuttings remaining in annulus, RT available cutting storage capacity and operational limits, and alarm systems, as needed.

Third-party cutting weigh system data or lagged return depth data is received and is tagged with lagged return depth and time. A calculation is made to determine the change in net CSU by subtracting the current total CSU weight minus the last received total CSU weight. The net change CSU is then added to the current total CSU weight to provide the updated cumulative net weight (time). The cumulative net weight (time) is then stored for future calculations. At least some of the processing described here may be performed by the application 104 executing on the computer 102 described above with reference to FIG. 1.

A process for collecting data flow at depth intervals is triggered by receiving the next lagged return depth interval reached. The last depth interval total CSU weight and current depth interval CSU weight are received to determine the net CSU depth. A calculation is made to determine the net change CSU depth by subtracting the last depth interval total CSU weight from the current depth total CSU weight. The net change CSU (depth) is then added to the current depth total CSU weight to provide the updated cumulative net weight (depth). The cumulative net weight (depth) is then stored for future calculations. At least some of the processing depicted in FIG. 8 and described here may be performed by the application 104 executing on computer 102 described above with reference to FIG. 1.

Two continuous calculations will run, both are a delta calculation between two set points. The first is performed based on the defined interval between transmitted data. This will determine the Δ NET CSU (Time) mass over that specified interval.

The second is performed based on a defined depth interval. This will determine a Δ NET CSU (interval) for a given depth interval. This depth interval is triggered based on the lagged return depth.

a. Example 1: If Total Rec NET CSU Mass is 1000 kg at a given transmitted time and 1050 kg at the next transmitted time the Δ NET CSU (Time) for the time interval would be 50 kg.
b. Example 2: If Total Rec NET CSU Mass is 1000 kg at Lag Depth 1001.0m and 1050 kg at Lag Depth 1002.0 m, the Δ NET CSU (Depth) for lagged return depth 1002.0 m would be 50 kg.

The Δ NET CSU (Time) and Δ NET CSU (Depth) will both be constantly tallied to create a Cumulative NET Weight (Time) and Cumulative NET Weight (Depth) dataset throughout the drilling section. This is the value that will be plotted and used as a comparison with the calculated cuttings weight from the LWD formation density tool.

For every specified depth and time interval drilled and circulated to surface, the mass of cuttings over that interval will be calculated based on either modelled or if available formation density data from logging while drilling tool. These initial values will be:

a. ΔCalcCuttingMass (Depth)
b. ΔCalcCuttingMass (Time)

The volume of cuttings generated (calculated by bit diameter) multiplied by the density of the formation will derive the mass of the cuttings in real-time. (Mass=Density× volume ($m=\rho\times V$)).

As the formation density tool will be offset from the bit, the measurement of density may not be immediately available, and an estimated formation density may be used for the initial calculation.

A list of expected formation densities against depth will be loaded into the software prior to commencing the drilling operation. This is the formation model data 108 described above with reference to FIG. 1.

The software (e.g., application 104) will check to see if LWD formation density data is available for the lagged return depth and will automatically determine what value to use. If the data is available then it will use the density data available from the logging while drilling tool (e.g., the LWD monitor station 120 and/or LWD sensors 122), if not then it will use the modelled data. The source of the formation density data used in the calculation will be marked in the database (e.g., in data store 116).

At a given time interval the software (e.g., application 104) will check to see if LWD formation data is available and automatically re-process the existing data. The software (e.g., application 104) will only re-process if the formation density data differs from the modelled data by more than a set percentage to avoid re-processing too frequently. At least some of the processing described above may be performed by the application 104 executing on computer 102 described above with reference to FIG. 1.

The re-processing of data may create additional delta data points:

a. ΔAdjustedCalcCuttingMass (Depth)
b. ΔAdjustedCalcCuttingMass (Time)

The four derived delta Cutting Mass (initial, adjusted, time and depth) will all both be constantly tallied to create cumulative datasets:

a. Initial Cumulative Calculated Weight removed (Time)
b. Initial Cumulative Calculated Weight removed (Depth)
c. Adjusted Cumulative Calculated Weight removed (Time)
d. Adjusted Cumulative Calculated Weight removed (Depth)

These are the values that will be plotted and used as a comparison with the Cumulative NET Weight (Time) & Cumulative NET Weight (Depth) from the Cutting storage tanks. At least some of the processing described above may be performed by the application 104 executing on computer 102 described above with reference to FIG. 1.

A tabulation showing simulated data provided below will show how data will be stored in the database or will show what data content will be stored in the database.

Data will be received continuously at a set transmission rate. On delivery of data to the cutting weight application, the software (e.g., application 104) will immediately tag the received data with the current time and lagged return depth.

The lagged return depth is a calculated depth value which is a determination of when a specific drilled interval has been circulated successfully from bit to surface through the annulus.

All data received will be given a lagged return depth tag.

Columns 2-9 are received data from the Cutting storage units. Column 1 and Column 10 are depth and time that may be tagged by a surface data logging (SDL) system.

Received Data Example

| Time & Date | Rec CSU 1 Mass | Rec CSU 2 Mass | Rec CSU 3 Mass | Rec CSU 4 Mass | Total Rec Gross CSU Mass | Total Rec NET CSU Mass | Lubricant Added | Lubricant Removed | Depth Tagged |
|---|---|---|---|---|---|---|---|---|---|
| dd-mm-yy hh:mm:ss | xx.xx | xx.xx | xx.xx | xx.xx | xx.xx | xx.xx | xx.xx | xx.xx | LAG DEPTH 1 |
| dd-mm-yy hh:mm:ss | xx.xx | xx.xx | xx.xx | xx.xx | xx.xx | xx.xx | xx.xx | xx.xx | LAG DEPTH 2 |
| dd-mm-yy hh:mm:ss | xx.xx | xx.xx | xx.xx | xx.xx | xx.xx | xx.xx | xx.xx | xx.xx | LAG DEPTH 3 |
| dd-mm-yy hh:mm:ss | xx.xx | xx.xx | xx.xx | xx.xx | xx.xx | xx.xx | xx.xx | xx.xx | LAG DEPTH 4 |
| dd-mm-yy hh:mm:ss | xx.xx | xx.xx | xx.xx | xx.xx | xx.xx | xx.xx | xx.xx | xx.xx | LAG DEPTH 5 |

The software (e.g., the application 104) will provide several graphical displays of the data. Representations of some anticipated graphs in some embodiments are discussed below. FIG. 5 shows a possible graph 400 with an X-axis 402 of measured depth and a Y-axis 404 of cumulative weight of cuttings. In an embodiment, the graph 400 may be presented on one or more display 124 to aid rig workers determining the status of the cuttings 168 in the wellbore and the status of the CSUs 114. The graph 400 shows a first trace 412 of expected initial calculated cumulative cuttings removal at lagged return depth, a second trace 410 of expected adjusted calculated cumulative cuttings removed at lagged return depth, a third trace 408 of cumulative net weight removed (calculated from CSU data), and a fourth trace 406 of offset data from previous well—weighed cumulative net cuttings removed from wellbore. Lithology data may be presented in a bar 414 at the top of the plot. The different lithology types extend over the range of measured depths that are relevant. The graph may further indicate azimuthal and wellbore directional data. The graph 400 may include a visual representation of the following:

a. Depth Plot
  i. X Axis Plot
    1. Lagged Return Depth.
    2. Formation & Lithology Data.
    3. ROP at drilled depth.
    4. Azimuthal & wellbore directional data.
  ii. Y Axis Plot
    1. Modelled calculated cumulative cuttings removed.
    2. LWD formation density derived calculated cumulative cuttings removal data.
    3. Actual weight of cuttings removed from well from CSU.
    4. Offset data from previous well sections (where applicable)
    5. Horizontal bar chart of lithology data with lithological legend for different formation types.

FIG. 6 shows a possible graph 420 with an X-axis 422 of time and a Y-axis 424 of cumulative weight of cuttings. A top bar 434 indicates rig activity at the time as drilling or circulating (e.g., circulating drilling fluid but not turning the bit with weight on it) at the corresponding time. A histogram 426 represents a rate of penetration (ROP) at the given time. When rig activity is circulating, the ROP is approximately zero. The graph 420 may comprise a first trace 428 that represents actual weighed cumulative net cuttings removed from the wellbore at the time, a second trace 430 that represents expected adjusted calculated cumulative cuttings removed based on received logging while drilling (LWD) formation density data for the lagged return depth at that time, and a third trace 432 that represents expected initial calculated net cumulative cuttings removed for the lagged return depth at the time.

b. Time Plot #1
  i. X Axis Plot
    6. Time.
    7. Drilling Activity.
    8. ROP.
    9. Azimuthal & wellbore directional data.
  ii. Y Axis Plot
  iii. Expected Initial calculated NET cumulative cuttings removed for the lagged return depth at that time.
  iv. Expected Adjusted calculated cumulative cuttings removed based on received LWD formation density data for the lagged return depth at that time.
  v. Actual weighed cumulative NET cuttings removed from wellbore at that time.

Figure 7:
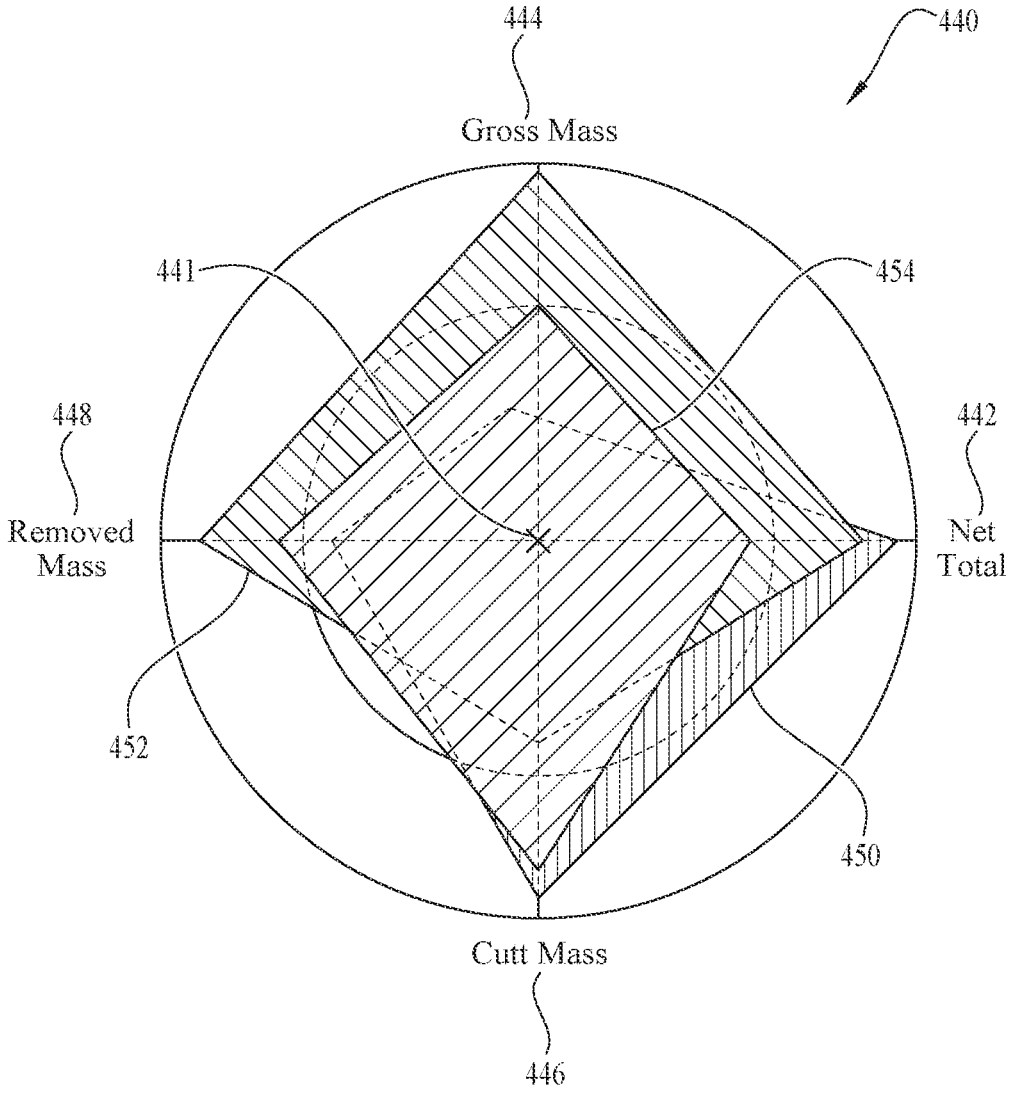
FIG. 7 is a process flow diagram for collecting received data flow over time according to an embodiment of the disclosure.

Hole Cleaning Efficiency Polygonal Plot Current Totals. FIG. 7 shows a polygon plot 440 of cuttings removal. The plot 440 represents net total cuttings 442 as a point on a horizontal axis displaced to the right of a center 441 a distance proportional to the value of net total cuttings; represents gross mass 444 as a point on a vertical axis displaced above the center 441 of the plot a distance proportional to the value of gross mass; represents cut mass 446 as a point on a vertical axis displaced below the center 441 a distance proportional to the value of cut mass; and represents removed mass 448 as a point on a horizontal axis displaced to the left of the center 441 a distance proportional to the value of removed mass. The plot 440 connects these points to form a polygon, in an embodiment, the values at different times can be represented by superpositioned or overlaid polygons, for example a first polygon 450 representing values at a first time, a second polygon 452 representing values at a second time later than the first time, and a third polygon 454 representing values at a third time later than the second time.

a. 1a. Gross Mass: What has come out since last zero of the system.
b. 1b. Removed Mass: What the system has calculated that should have been circulated out the annulus. Also referred to as the volume of drilled system up to current lag depth.
c. 1c. Net Total: The gross mass—any lubricant (Data received from the Cutting Storage unit system)
d. 1d. Cut Mass—Total weight of cuttings in the well.

In an embodiment, the Hole Cleaning Efficiency—Current Totals may be represented as a sequence of polygons (see below), where the apexes are determined by Gross Mass, Removed Mass, Net Total, and Cutt mass. A plurality of these polygons may be overlaid to represent how the values of these four parameters have changed over time.

Figure 8:
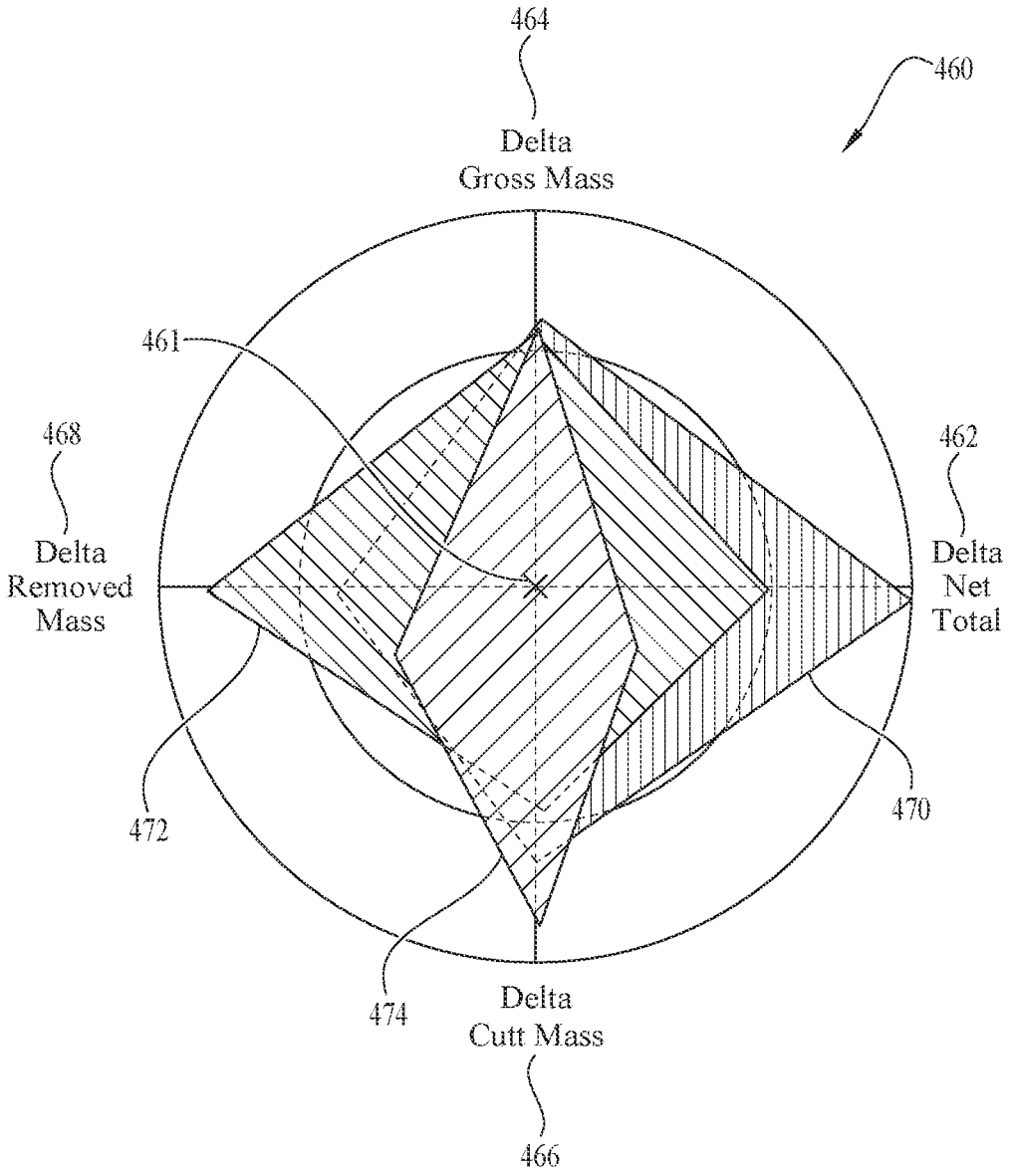
FIG. 8 is a process flow diagram for collecting data flow at depth intervals according to an embodiment of the disclosure.

Hole Cleaning Efficiency Polygonal Plot—Delta Weights. FIG. 8 shows a polygon plot 460 of cuttings removal delta weight. The plot 460 represents delta net total 462 as a point on a horizontal axis displaced to the right of a center 461 of the plot a distance proportional to the value of delta net total; represents delta gross mass 464 by a point on a vertical axis displaced above the center 461 a distance proportional to the value of delta gross mass; represents delta cut mass 466 by a point on the vertical axis displaced below the center 461 a distance proportional to the value of delta cut mass; and represents delta removed mass 468 by a point on the horizontal axis displaced to the left of the center 461 a distance proportional to the value of delta removed mass. The plot 460 connects these points to form a polygon. In an embodiment, the values at different times can be represented by superpostioned or overlaid polygons, for example a first polygon 470 representing values at a first time, a second polygon 472 representing values at a second time later than the first time, and a third polygon 474 representing values at a third time later than the second time.

These are the Δ (Time Interval) of items 1a-1d:

a. 2a, Delta Gross Mass=Current value—last value
b. 2b. Delta Net Total Current value—last value
c. 2c. Delta Removed Mass=Current value—last value
d. 2d. Delta. Cutt Mass Current value—last calculated In an embodiment, the Hole Cleaning Efficiency Delta Weights may be represented as a sequence of polygons (see below), where the apexes are determined by Delta Gross Mass, Delta Removed Mass, Delta Net Total, and Delta Cutt mass. A plurality of these polygons may be overlaid to represent how the values of these four parameters have changed over time.

Figure 9:
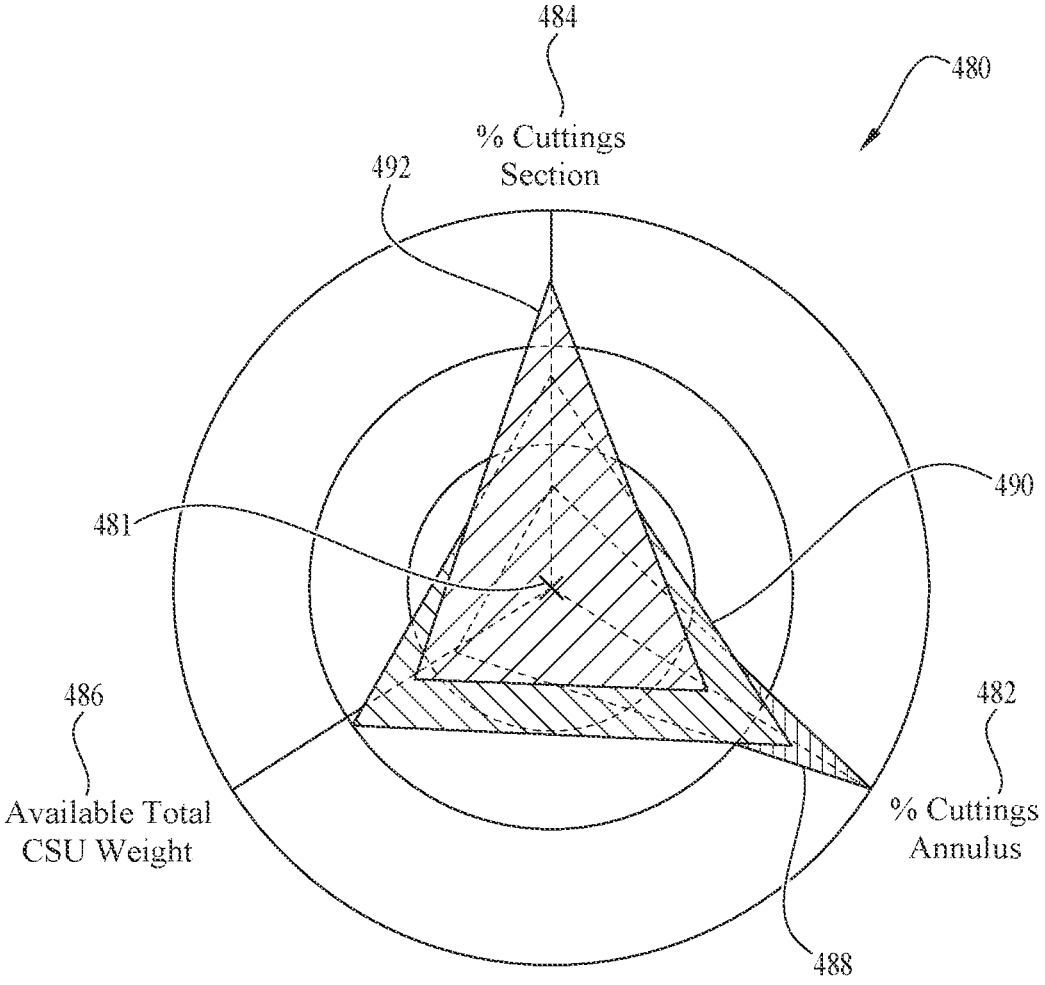
FIG. 9 is a process flow diagram for initial calculation of cutting weight from a bit diameter and formation density data according to an embodiment of the disclosure.

Hole Cleaning Efficiency Polygonal Plot—% Ratios. FIG. 9 shows a polygon plot 480 of cuttings. The plot 480 represents % cuttings annulus 482 as a point on an axis displaced from a center 481 by a distance proportion to the value of % cuttings annulus; represents % cuttings section 484 as a point on an axis displaced from the center 481 by a distance proportional to the value of % cuttings section; and represents available total CSU weight 486 as a point on an axis displaced from the center 481 by a distance proportional to the value of available total CSU weight. The plot 480 connects these points to form a triangular polygon. In an embodiment, the values at different times can be represented by superpositioned or overlaid triangular polygons, for example a first triangular polygon 488 representing values at a first time, a second triangular polygon 490 representing values at a second time later than the first time, and a third triangular polygon 492 representing values at a third time later than the second time.

a. 3a. % Cuttings Annulus—Calculated cuttings volume in wellbore as a percentage of total annular volume (Cuttings Loading).
b. 3b. % Cuttings Section—Percentage of cuttings that have been removed as a percentage of the section. i.e. If we have drilled 100 m and this value is 50% 50 m of cuttings will have been circulated out of the annulus. A high value of 3b would show good hole cleaning, low vale would show poor hole cleaning. If you have more than 100% you potentially have a well out of gauge/caving's.
c. 3c. Available Total CSU weight—Available free capacity of all CSUs in the system.

In an embodiment, the Hole Cleaning Efficiency— % Ratios may be represented differently as a sequence of triangles (see above), where the apexes are determined by % Cuttings Section, % Cuttings Annulus, and Available Total CSU Weight. A plurality of these triangles may be overlaid to represent how the values of these three parameters have changed over time.

Figure 10:
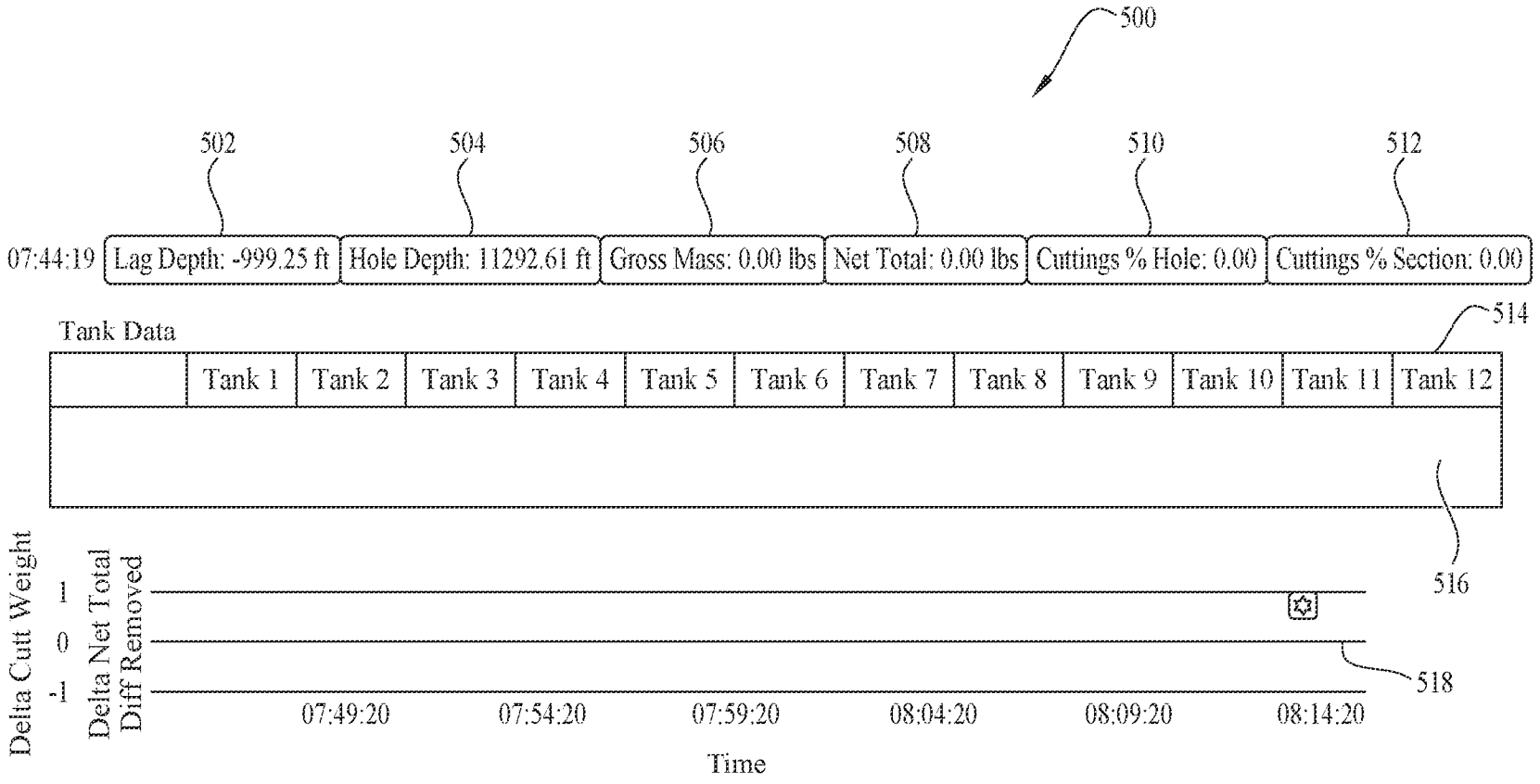
FIG. 10 is a process flow diagram fir re-processing calculation of cutting weight from bit diameter and formation density data according to an embodiment of the disclosure.

FIG. 10 shows a summary screen 500 that provides summarized information and a graph. The summary screen 500 provides a current lagged depth value 502, a current hole depth 504, a gross mass 506, a net total 508, a cuttings % hole 510, and a cuttings % section. A band 514 presents a weight in each of a plurality of CSUs 114 or tanks. At graph 518, information can be displayed versus time.

Figure 11:
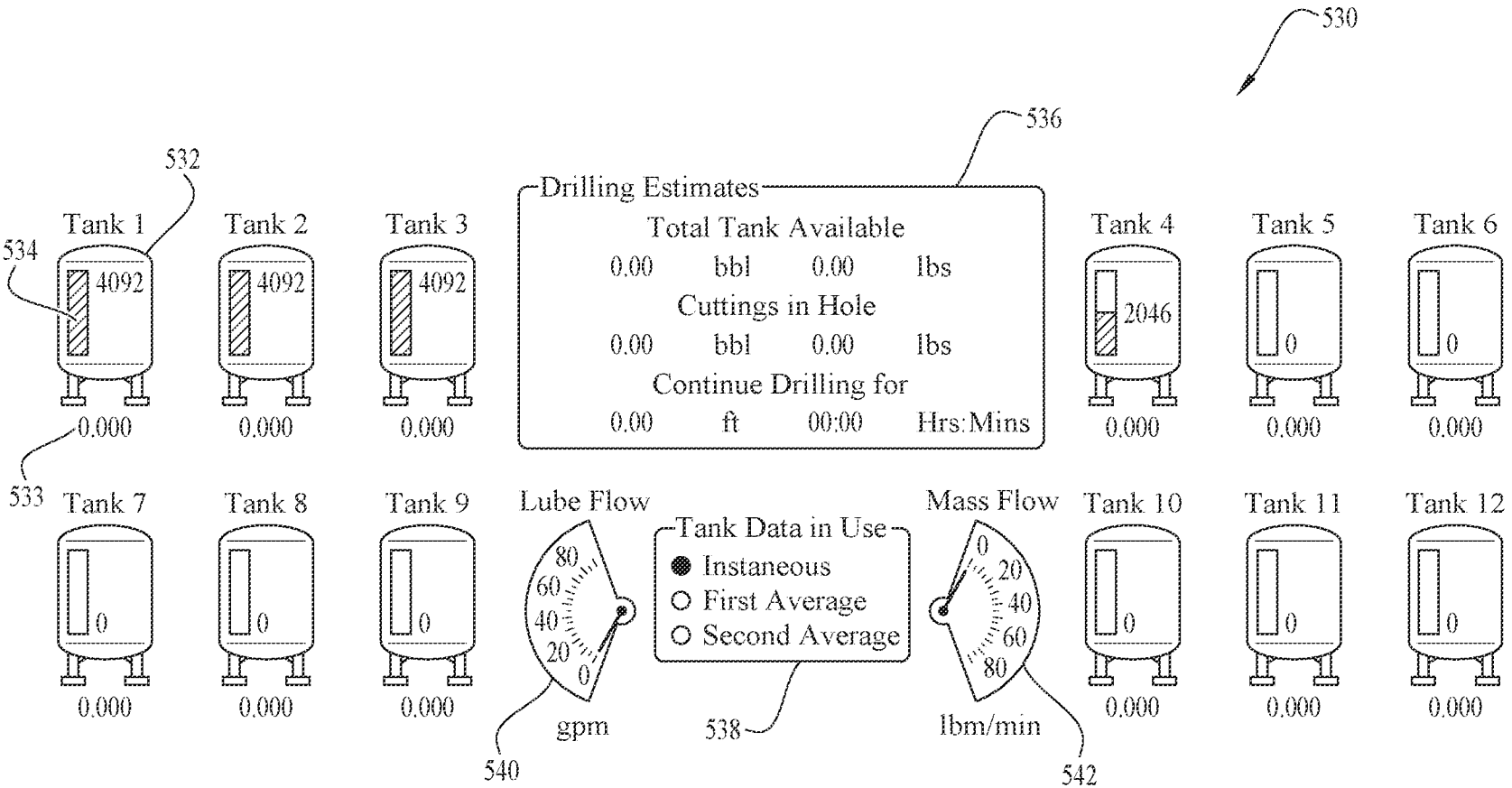
FIG. 11 is an illustration of a cuttings storage unit (CSU) weight display screen according to an embodiment of the disclosure.

FIG. 11 shows a CS Us weight screen 530. The screen 530 shows a plurality of representations of CSUs 114 or tanks with an indication within the CSU representation of how full it is. The indication 536 shows the first tank 532 full. The weight of the tank is displayed beneath the representation of the CS U 114. A drilling estimates 536 portion of the screen 530 presents estimates of total tank available in units of barrels and in units of pounds, cuttings in hole in units of barrels and in units of pounds, and continue drilling in units of feet and in units of time (at present rate of penetration). A representation of a dial 540 indicates a current rate of cuttings lubrication flow. A representation of a dial 542 indicates a current rate of cuttings mass flow. A tank data in use input selection 538 allows for selecting display of instantaneous data, display of data averaged over a first number of data samples, and display of data averaged over a second different number of data samples.

Additional Calculations in the software (e.g., application 104) to determine real-time operational limits: The software will also calculate additional information to aid in users. They include the following:

a. Free Cutting Storage Unit capacity
b. Estimated cuttings in hole
c. Estimated available drilling footage and time at current ROP with current cuttings storage unit capacity and current formation density.
   1. CSU free capacity: mass (m) and volume (v)
a. Mass=Total CSU weight capacity when empty Current Total CSU combined weight.
b. Volume Mass/Density of current formation 2. Estimated cutting=s in hole: volume (v)

a. Volume=$\pi r^2$ h b. h=Current Bit Depth—Lagged Return Depth*)

c. r Bit diameter/2

Calculated using annular volume & pump rate using Halliburton InSite lag calculation 3. Estimated available drilling footage and time at current ROP with current cuttings storage unit capacity and current formation density.

a. NET Available volume (NETAvailVol)=1. CSU free capacity (v)—2. Estimated cuttings in hole (v)

b. Volume of cuttings generated per minute (VolCutPerMin)=$\pi r^2$ h)/60 c. h=ROP d. r=Bit diameter/2 i. 3a. Estimated available drilling time at current ROP=NETAvailVol/VolCutPerMin ii. 3b. Estimated available drilling footage at current. ROI"=ROP×3a.

Estimated available drilling time at current ROP.

EXAMPLES

The embodiments having been generally described, the following examples are given as particular embodiments of the disclosure and to demonstrate the practice and advantages thereof. It is understood that the examples are given by way of illustration and are not intended to limit the specification or the claims in any manner.

Weighed Cuttings at Lag Depth

| intend | Cum Mass | Difference |
|---|---|---|
| 789 | 789 | −199.49 |
| 754 | 1543 | −433.98 |
| 752 | 2295 | −557.18 |
| 802 | 3097 | −666.49 |
| 829 | 3926 | −773.14 |
| 898 | 4824 | −824.47 |
| 741 | 5565 | −1031.66 |
| 879 | 6444 | −1099.71 |
| 909 | 7853 | −1141.94 |
| 827 | 8180 | −1266.94 |
| 858 | 9038 | −1356.37 |
| 783 | 9821 | −1522.32 |
| 789 | 10610 | −1693.29 |
| 801 | 11411 | −1853.41 |
| 921 | 12332 | −1892.39 |
| 919 | 13251 | −1927.66 |
| 758 | 14009 | −2127.74 |
| 934 | 14943 | −2152.20 |
| 793 | 15736 | −2320.31 |
| 820 | 16556 | −2469.80 |
| 928 | 17484 | −2506.34 |
| 926 | 18410 | −2544.49 |
| 892 | 19302 | −2618.17 |
| 739 | 20041 | −2842.19 |
| 769 | 20810 | −3036.97 |
| 748 | 21558 | −3256.93 |
| 932 | 22490 | −3290.99 |
| 789 | 23279 | −3470.33 |
| 840 | 24119 | −3601.34 |
| 783 | 24902 | −3789.72 |
| 928 | 25830 | −3833.10 |

Depth Data Examples

| Depth Intvl (m) | | | Hole Dia (in) | Volume | Cumulative Volume | Formation Density (kg/m3) | | Delta Formation Mass (kg) | | Cumulative Formation Mass | |
|---|---|---|---|---|---|---|---|---|---|---|---|
| From | To | Drill Intvl | | Drilled (m3) | Drilled (m3) | Model | RT | Model | RT | Model | RT |
| 1000 | 1005 | 5 | 12.25 | 0.38018896 | 0.380188955 | 2350 | 2600 | 893.444045 | 988.491284 | 893.444045 | 988.491284 |
| 1005 | 1010 | 5 | 12.25 | 0.38018896 | 0.760377911 | 2350 | 2600 | 893.444045 | 988.491284 | 1786.88809 | 1976.98257 |
| 1010 | 1015 | 5 | 12.25 | 0.38018896 | 1.140566866 | 2350 | 2302 | 893.444045 | 875.194975 | 2680.33214 | 2852.17754 |
| 1015 | 1020 | 5 | 12.25 | 0.38018896 | 1.520755822 | 2350 | 2397 | 893.444045 | 911.312926 | 3573.77618 | 3763.49047 |
| 1020 | 1025 | 5 | 12.25 | 0.38018896 | 1.900944777 | 2350 | 2461 | 893.444045 | 935.645019 | 4467.22023 | 4699.13549 |
| 1025 | 1030 | 5 | 12.25 | 0.38018896 | 2.281133732 | 2350 | 2497 | 893.444045 | 949.331822 | 5360.66427 | 5648.46731 |
| 1030 | 1035 | 5 | 12.25 | 0.38018896 | 2.661322688 | 2350 | 2494 | 893.444045 | 948.191255 | 6254.10832 | 6596.65857 |
| 1035 | 1040 | 5 | 12.25 | 0.38018896 | 3.041511643 | 2350 | 2491 | 893.444045 | 947.050688 | 7147.55236 | 7543.70925 |
| 1040 | 1045 | 5 | 12.25 | 0.38018896 | 3.421700599 | 2350 | 2502 | 893.444045 | 951.232766 | 8040.99641 | 8494.94202 |
| 1045 | 1050 | 5 | 12.25 | 0.38018896 | 3.801889554 | 2350 | 2504 | 893.444045 | 951.993144 | 8934.44045 | 9446.93516 |
| 1050 | 1055 | 5 | 12.25 | 0.38018896 | 4.18207851 | 2350 | 2492 | 893.444045 | 947.430877 | 9827.8845 | 10394.366 |
| 1055 | 1060 | 5 | 12.25 | 0.38018896 | 4.562267465 | 2350 | 2496 | 893.444045 | 948.951633 | 10721.3285 | 11343.3177 |
| 1060 | 1065 | 5 | 12.25 | 0.38018896 | 4.94245642 | 2350 | 2525 | 893.444045 | 959.977112 | 11614.7726 | 12303.2948 |
| 1065 | 1070 | 5 | 12.25 | 0.38018896 | 5.322645376 | 2350 | 2528 | 893.444045 | 961.117679 | 12508.2166 | 13264.4125 |
| 1070 | 1075 | 5 | 12.25 | 0.38018896 | 5.702834331 | 2350 | 2525 | 893.444045 | 959.977112 | 13401.6607 | 14224.3896 |
| 1075 | 1080 | 5 | 12.25 | 0.38018896 | 6.083023287 | 2350 | 2510 | 893.444045 | 954.274278 | 14295.1047 | 15178.6639 |
| 1080 | 1085 | 5 | 12.25 | 0.38018896 | 6.463212242 | 2350 | 2520 | 893.444045 | 958.076168 | 15188.5488 | 16136.74 |
| 1085 | 1090 | 5 | 12.25 | 0.38018896 | 6.843401197 | 2350 | 2521 | 893.444045 | 958.456357 | 16081.9928 | 17095.1964 |
| 1090 | 1095 | 5 | 12.25 | 0.38018896 | 7.223590153 | 2350 | 2528 | 893.444045 | 961.117679 | 16975.4369 | 18056.3141 |
| 1095 | 1100 | 5 | 12.25 | 0.38018896 | 7.603779108 | 2350 | 2550 | 893.444045 | 969.481836 | 17868.8809 | 19025.7959 |
| 1100 | 1105 | 5 | 12.25 | 0.38018896 | 7.983968064 | 2350 | 2537 | 893.444045 | 964.53938 | 18762.3249 | 19990.3353 |
| 1105 | 1110 | 5 | 12.25 | 0.38018896 | 8.364157019 | 2350 | 2536 | 893.444045 | 964.159191 | 19655.769 | 20954.4945 |
| 1110 | 1115 | 5 | 12.25 | 0.38018896 | 8.744345974 | 2350 | 2540 | 893.444045 | 965.679947 | 20549.213 | 21920.1744 |
| 1115 | 1120 | 5 | 12.25 | 0.38018896 | 9.12453493 | 2350 | 2533 | 393.444045 | 963.018624 | 21442.6571 | 22883.193 |
| 1120 | 1125 | 5 | 12.25 | 0.38018896 | 9.504723885 | 2350 | 2535 | 893.444045 | 963.779002 | 22336.1011 | 23846.972 |
| 1125 | 1130 | 5 | 12.25 | 0.38018896 | 9.884912841 | 2350 | 2546 | 893.444045 | 967.96108 | 23229.5452 | 24814.9331 |
| 1130 | 1135 | 5 | 12.25 | 0.38018896 | 10.2651018 | 2350 | 2541 | 893.444045 | 966.060136 | 24122.9892 | 25780.9933 |
| 1135 | 1140 | 5 | 12.25 | 0.38018896 | 10.64529075 | 2350 | 2547 | 393.444045 | 968.341269 | 25016.4333 | 26749.3345 |
| 1140 | 1145 | 5 | 12.25 | 0.38018896 | 11.02547971 | 2350 | 2554 | 893.444045 | 971.002592 | 25909.8773 | 27720.3371 |
| 1145 | 1150 | 5 | 12.25 | 0.38018896 | 11.40566866 | 2350 | 2555 | 893.444045 | 971.382781 | 26803.3214 | 28691.7199 |
| 1150 | 1155 | 5 | 12.25 | 0.38018896 | 11.78585762 | 2350 | 2555 | 893.444045 | 971.382781 | 27696.7654 | 29663.1027 |

Figure 12:
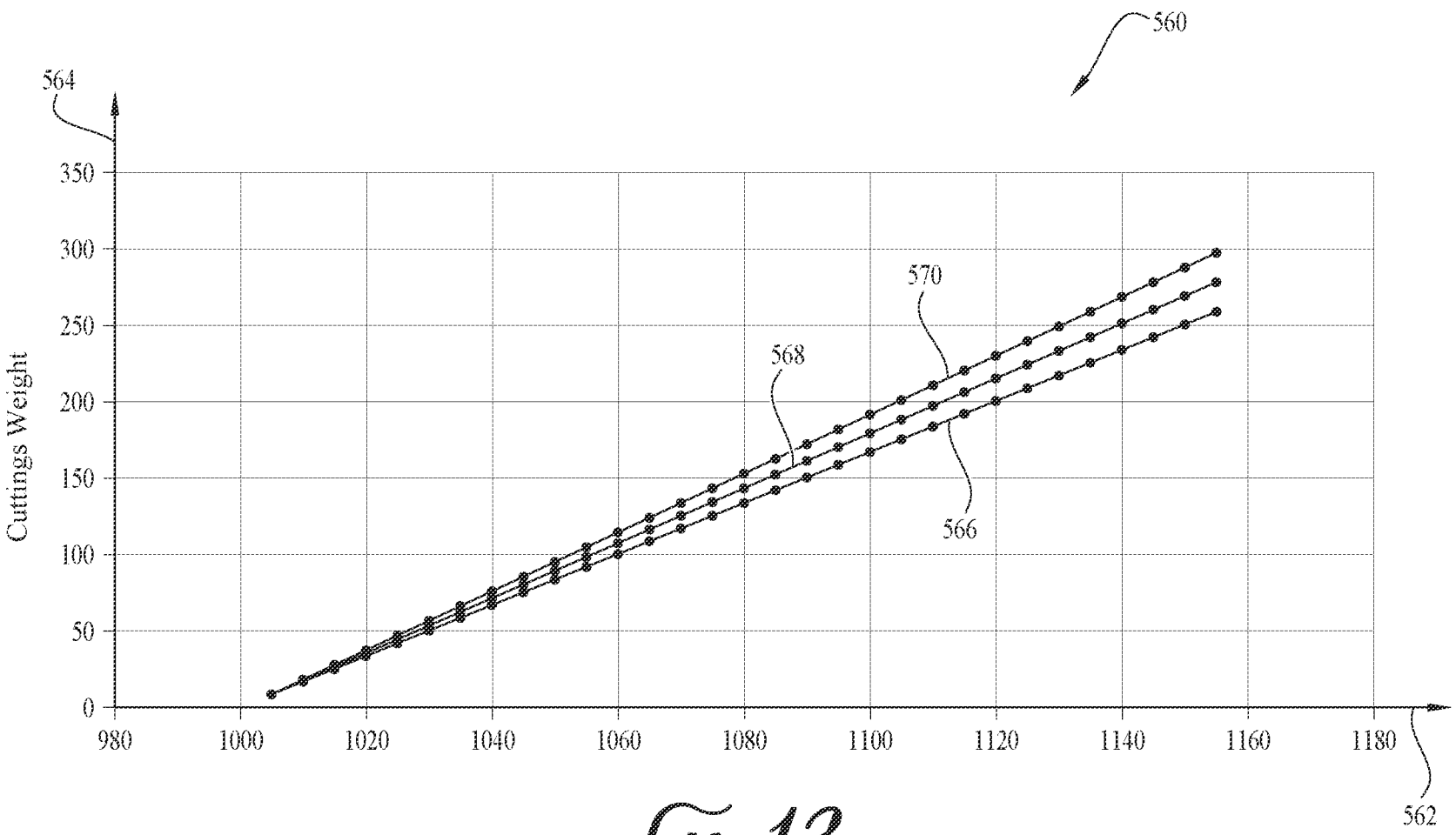
FIG. 12 is an illustration of a plot of cuttings weight display screen according to an embodiment of the disclosure.

In an embodiment, the application 104 can present a screen as shown in FIG. 12. FIG. 12 shows a plot 560 of cuttings weight. An X-axis 562 is the depth, and a Y-axis 564 is the 3 cuttings weight. A first trace 566 represents cumulative weight; a second trace 568 represents weight based on model formation density values; and a third trace 570 represents weight based on real-time density data (e.g., logging while drilling density data).

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

Additional Disclosure

In an embodiment, the described system and solution does not depend upon installation in a shaker house and may use weight data provided by a third-patty who has installed weight measurements on cutting storage units.

This solution uses real-time and/or near real-time measured LWD data provided from downhole tools to provide real-time and/or near real-time formation density data for calculating cuttings volume from weight. This solution will aim to provide more accurate data on hole cleaning efficiency and free CSU space and remaining drilling time and/or remaining drilling feet before free CSU space is exhausted.

The following are non-limiting, specific embodiments in accordance with the present disclosure.

A first embodiment, which is a method of adapting drilling of a borehole in a subterranean formation based on comparing a received cuttings weight to an expected cuttings weight, comprising determining the received cuttings weight by an application executing on a computer based on data received from a cuttings storage unit (CSU) data collection station; determining the expected cuttings weight by the application based on a current borehole depth, on a drill bit geometry, and on a cuttings density value; presenting a representation of the received cuttings weight and a representation of the expected cuttings weight on a display; and adapting a parameter of drilling of the borehole based on comparing the representation of the received cuttings weight to the representation of the expected cuttings weight.

A second embodiment, which is the method of the first embodiment, wherein the parameter comprises a weight on bit.

A third embodiment, which is the method of the first or second embodiments, wherein the parameter comprises a rate of penetration (ROP).

A fourth embodiment, which is the method of any of the first through the third embodiments, wherein the parameter comprises a mud weight.

A fifth embodiment, which is the method of any of the first through the fourth embodiments, wherein the parameter comprises a mud viscosity.

A sixth embodiment, which is the method of any of the first through the fifth embodiments, wherein the parameter comprises a mud pump output pressure.

A seventh embodiment, which is the method of any of the first through the sixth embodiments, wherein the parameter comprises a mud pump output flow rate.

An eighth embodiment, which is the method of any of the first through the seventh embodiments, wherein the cuttings density value is determined by the application based on a formation density model and based on the current borehole depth.

A ninth embodiment, which is the method of any of the first through the seventh embodiments, wherein the cuttings density value is determined by the application based on data received from a logging while drilling (LWD) monitor station.

A tenth embodiment, which is any of the first through the ninth embodiments, further comprising in the absence of received logging while drilling (LWD) data, determining the cuttings density value based on a formation density model and based on the current borehole depth; and, in response to receiving data from a logging while drilling (LWD) monitor station, determining the cuttings density value based on the data received from the LWD monitor station.

An eleventh embodiment, which is the method of the tenth embodiment, wherein determining the received cuttings weight comprises determining a plurality of received cuttings weight accumulated values by the application, wherein determining the expected cuttings weight comprises determining a plurality of expected cuttings weight accumulated values by the application, further comprising, in response to receiving data from the LWD monitor station, redetermining at least some of the expected cuttings weight accumulated values that were determined based on the cuttings density value determined based on the formation density model and based on the current borehole depth, wherein the redetermining is based on the cuttings density value determined based on the data received from the LWD monitor station.

A twelfth embodiment, which is the method of any of first through the eleven embodiments, wherein determining the received cuttings weight is performed by the application in response to receiving data from the CSU data collection station.

A thirteenth embodiment, which is the method of any of the first through the twelfth embodiments, wherein the data received from the CSU data collection station is received by the application periodically.

A fourteenth embodiment, which is the method the thirteenth embodiment, wherein the data received from the CSU data collection station is received periodically by the application on an interval between every 10 seconds and every 60 seconds.

A fifteenth embodiment, which is the method of any of the first through the fourteenth embodiments, wherein determining the received cuttings weight comprises the application determining a net received cuttings weight and subtracting a lubrication weight from the net received cuttings weight to determine the received cuttings weight.

A sixteenth embodiment, which is the method of any of the first through the fifteenth embodiment, wherein presenting the representation of the received cuttings weight comprises the application presenting the representation of the received cutting=s weight versus time.

A seventeenth embodiment, which is the method of any of the first through the sixteenth embodiments, wherein presenting the representation of the received cuttings weight comprises the application presenting the representation of the received cuttings weight versus lagged return depth.

An eighteenth embodiment, which is the method of the seventeenth embodiment, wherein lagged return depth is calculated by the application based on an estimated cuttings uphole movement rate and on borehole depth data.

A nineteenth embodiment, which is the method of any of the fi-st through the eighteenth embodiment, wherein presenting the representation of the expected cuttings weight on a display comprises the application presenting the representation of the expected cuttings weight versus time.

A twentieth embodiment, which is the method of any of the first through the nineteenth embodiment, wherein presenting the representation of the expected cuttings weight on a display comprises the application presenting the representation of the expected cuttings weight versus depth.

A twenty-first embodiment, which is any of the first through the twentieth embodiments, further comprising determining and presenting by the application a free CSU capacity.

A twenty-second embodiment, which is any of the first through the twenty-first embodiments, further comprising determining and presenting by the application an estimated weight of cuttings in hole value.

A twenty-third embodiment, which is any of the first through the twenty-second embodiments, further comprising determining and presenting by the application an estimated available drilling footage and an estimated time based on a current rate of penetration, the drill bit geometry, a free CSU capacity, and the cuttings density value.

A twenty-fourth embodiment, which is the method of any of the first through the twenty-third embodiments, further comprising pumping a pill down a drill string in the borehole based on the presented representation.

A twenty-fifth embodiment, which is a system for adapting drilling of a borehole in a subterranean formation based on comparing a received cuttings weight to an expected cuttings weight, comprising a processor; a non-transitory memory; at least one display; and an application stored in the non-transitory memory that, when executed by the processor, determines the received cuttings weight based on data received from a cuttings storage unit (CSU); determines the expected cuttings weight based on a current borehole depth, on a drill bit geometry, and on a cuttings density value; and presents a representation of the received cutting=s weight and a representation of the expected cuttings weight on the at least one display, whereby at least one parameter of drilling of the borehole is adapted based on comparing the representation of the received cuttings to the representation of the expected cuttings weight.

A twenty-sixth embodiment, which is the system of the twenty-fifth embodiment, wherein the cuttings density value is looked up by the application in a formation density model based on the current borehole depth.

A twenty-seventh embodiment, which is the system of the twenty-fifth embodiment or the twenty-sixth embodiment, wherein the cuttings density value is determined by the application based on cuttings density data received from a logging while drilling (LWD) monitor station.

A twenty-eighth embodiment, which is the system of the twenty-fifth embodiment, wherein the application determines the cuttings density value based on cuttings density data received from a logging while drilling (LAVD) monitor station when cuttings density data is received from the LWD monitor station and the application looks up the cuttings density value in a formation density model based on the current borehole depth when cuttings density data is not received from the LWD monitor station.

A twenty-ninth embodiment, which is the system of any of the twenty-fifth through the twenty-eighth embodiment, wherein the application determines a plurality of received cuttings weight accumulated values, wherein the application determines a plurality of expected cuttings weight accumulated values, and wherein the application, in response to receiving cuttings density data from the LWD monitor station, redetermines at least some of the expected cuttings weight accumulated values that were determined based on the cuttings density value determined based on the formation density model and based on the current borehole depth, wherein the redetermining is based on the cuttings density value determined based on the cuttings density data received from the LWD monitor station.

A thirtieth embodiment, which is the system any of the twenty-fifth through the twenty-ninth embodiments, wherein the at least one parameter of drilling the borehole that is adapted comprises a weight on bit.

A thirty-first embodiment, which is the system of any of the twenty-fifth through the thirtieth embodiments, wherein the at least one parameter of drilling the borehole that is adapted comprises a rate of rotation of a drill bit.

A thirty-second embodiment, which is the system of any of the twenty-fifth through the thirty-first embodiments, wherein the at least one parameter of drilling the borehole that is adapted comprises a rate of penetration (ROP).

A thirty-third embodiment, which is the system of any of the twenty-fifth through the thirty-second embodiments, wherein the at least one parameter of drilling the borehole that is adapted comprises a mud weigh.

A thirty-fourth embodiment, which is the system of any of the twenty-fifth through the thirty-third embodiments, wherein the at least one parameter of drilling the borehole that is adapted comprises a mud viscosity.

A thirty-fifth embodiment, which is the system of any of the twenty-fifth through the thirty-fourth embodiments, wherein the at least one parameter of drilling the borehole that is adapted comprises a mud pump output pressure.

A thirty-sixth embodiment, which is the system of any of the twenty-fifth through the thirty-fifth embodiments, wherein the at least one parameter of drilling the borehole that is adapted comprises a mud pump output flow rate.

A thirty-seventh embodiment, which is the system of any of the twenty-fifth through the thirty-sixth embodiments, system of any of claim 25, claim 26, claim 27, claim 28, claim 29, claim 30, claim 31, claim 32, claim 33, claim 34, claim 35, or claim 36, wherein a hole cleaning operation is performed based on comparing the representation of the received cuttings to the representation of the expected cuttings weight.

A thirty-eighth embodiment, which is the System of thirty-seventh embodiment, wherein the hole cleaning operation comprises pumping a pill down a drill string in the borehole.

A thirty-ninth embodiment, which is the system of any of the twenty-fifth through the thirty-eighth embodiment, wherein the representation of received cuttings weight represents received cuttings weight versus time.

A fortieth embodiment, which is the system of any of the twenty-fifth through the thirty-ninth embodiments, wherein the representation of the received cuttings weight represents the received cuttings weight versus lagged return depth.

A forty-first embodiment, which is the system of any of the twenty-fifth through the fortieth embodiments, wherein lagged return depth is calculated by the application based on an estimated cuttings uphole movement rate and on borehole depth data.

A forty-second embodiment, which is the system of any of the twenty-fifth through the forty-first embodiments, wherein the representation of received cuttings weight represents received cuttings weight versus time and versus lagged return depth.

A forty-third embodiment, which is the system of any of the twenty-fifth through the forty-second embodiments, wherein the representation of the expected cuttings weight represents the expected cuttings weight versus time.

A forty-fourth embodiment, which is the system of any of the twenty-fifth through the forty-third embodiments, wherein the representation of the expected cuttings weight represents the expected cuttings weight versus depth.

A forty-fifth embodiment, which is the system of any of the twenty-fifth through the forty-fourth embodiments, wherein the representation of the expected cuttings weight represents the expected cuttings weight versus time and versus depth.

A forty-sixth embodiment, which is the system of any of the twenty-fifth through the forty-fifth embodiments, wherein the application further determines an estimated weight of cuttings in hole value and presents the estimated weight of cuttings in hole value on the at least one display.

A forty-seventh embodiment, which is the system of any of the twenty-fifth through the forty-sixty embodiments, wherein the application further determines a free CSU capacity and presents the free CSU capacity on the at least one display.

A forty-eighth embodiment, which is the system of any of the twenty-fifth through the forty-seventh embodiments, wherein the application further determines an estimated available drilling footage and an estimated time that drilling can continue based on a current rate of penetration, the drill bit geometry, a free CSU capacity, and the cuttings density value.

What is claimed is:

1. A method of adapting drilling of a borehole in a subterranean formation based on comparing a received cuttings weight to an expected cuttings weight, comprising:

determining a net received cuttings weight by an application executing on a computer based on data received from a cuttings storage unit (CSU) data collection station;

determining the received cuttings weight by the application by subtracting a lubrication weight from the net received cuttings weight;

determining the expected cuttings weight by the application based on a current borehole depth, on a drill bit geometry, and on a cuttings density value;

presenting a representation of the received cuttings weight and a representation of the expected cuttings weight on a display; and adapting a parameter of drilling of the borehole based on comparing the real-time representation of the received cuttings weight to the real-time representation of the expected cuttings weight.

2. The method of claim 1, wherein the parameter comprises a weight on bit, a rate of penetration (ROP), a mud weight, a mud viscosity, a mud pump output pressure, or a mud pump output flow rate.

3. The method of claim 1, wherein the cuttings density value is determined by the application based on data received from a logging while drilling (LWD) monitor station or based on a formation density model and the current borehole depth.

4. The method of claim 3, further comprising:

in the absence of received LWD data, determining the cuttings density value based on the formation density model and based on the current borehole depth; and in response to receiving data from the LWD monitor station, determining the cuttings density value based on the data received from the LWD monitor station.

5. The method of claim 4, wherein determining the received cuttings weight comprises determining a plurality of received cuttings weight accumulated values by the application, wherein determining the expected cuttings weight comprises determining a plurality of expected cuttings weight accumulated values by the application, further comprising, in response to receiving data from the LWD monitor station, redetermining at least some of the expected cuttings weight accumulated values that were determined based on the cuttings density value determined based on the formation density model and based on the current borehole depth, wherein the redetermining is based on the cuttings density value determined based on the data received from the LWD monitor station.

6. The method of claim 1, wherein presenting the real-time representation of the received cuttings weight comprises the application presenting the real-time representation of the received cuttings weight versus time or versus lagged return depth.

7. The method of claim 6, wherein lagged return depth is calculated by the application based on an estimated cuttings uphole movement rate and on borehole depth data.

8. The method of claim 1, further comprising determining and presenting by the application a free CSU capacity.

9. The method of claim 1, further comprising determining and presenting by the application an estimated available drilling footage and an estimated time based on a current rate of penetration, the drill bit geometry, a free CSU capacity, and the cuttings density value.

10. The method of claim 1, wherein the data received from the CSU data collection station is received by the application periodically.

11. A system for adapting drilling of a borehole in a subterranean formation based on comparing a received cuttings weight to an expected cuttings weight, comprising:

a processor;

a non-transitory memory;

at least one display; and an application stored in the non-transitory memory that, when executed by the processor, determines a net received cuttings weight based on data received from a cuttings storage unit (CSU), determines the received cuttings weight by subtracting a lubrication weight from the net received cuttings weight;

determines the expected cuttings weight based on a current borehole depth, on a drill bit geometry, and on a cuttings density value; and presents a real-time representation of the received cuttings weight and a real-time representation of the expected cuttings weight on the at least one display, whereby at least one parameter of drilling of the borehole is adapted based on comparing the real-time representation of the received cuttings to the real-time representation of the expected cuttings weight.

12. The system of claim 11, wherein the cuttings density value is determined by the application based on cuttings density data received from a logging while drilling (LWD) monitor station or is looked up by the application in a formation density model based on the current borehole depth.

13. The system of claim 12, wherein the application determines the cuttings density value based on cuttings density data received from the LWD monitor station when cuttings density data is received from the LWD monitor station and the application looks up the cuttings density value in the formation density model based on the current borehole depth when cuttings density data is not received from the LWD monitor station.

14. The system of claim 13, wherein the application determines a plurality of received cuttings weight accumulated values, wherein the application determines a plurality of expected cuttings weight accumulated values, and wherein the application, in response to receiving cuttings density data from the LWD monitor station, redetermines at least some of the expected cuttings weight accumulated values that were determined based on the cuttings density value determined based on the formation density model and based on the current borehole depth, wherein the redetermining is based on the cuttings density value determined based on the cuttings density data received from the LWD monitor station.

15. The system of claim 11, wherein the at least one parameter of drilling the borehole that is adapted comprises a weight on bit, a rate of rotation of a drill bit, a rate of penetration (ROP), a mud weight, a mud viscosity, a mud pump output pressure, or a mud pump output flow rate.

16. The system of claim 11, whereby a hole cleaning operation is performed based on comparing the real-time representation of the received cuttings to the real-time representation of the expected cuttings weight.

17. The system of claim 16 wherein the hole cleaning operation comprises pumping a pill down a drill string in the borehole.

18. The system of claim 11, wherein the application further determines an estimated weight of cuttings in hole value and presents the estimated weight of cuttings in hole value on the at least one display.

19. The system of claim 11, wherein the application further determines a free CSU capacity and presents the free CSU capacity on the at least one display.

20. The system of claim 11, wherein the application further determines an estimated available drilling footage and an estimated time that drilling can continue based on a current rate of penetration, the drill bit geometry, a free CSU capacity, and the cuttings density value.

* * * * *